US011313197B2

(12) United States Patent
Sorensen

(10) Patent No.: US 11,313,197 B2
(45) Date of Patent: Apr. 26, 2022

(54) WELL ACCESS TOOL

(71) Applicant: QUALITY INTERVENTION TECHNOLOGY AS, Balestrand (NO)

(72) Inventor: Bjorn Bro Sorensen, Notteroy (NO)

(73) Assignee: Quality Intervention Technology AS, Balestrand (NO)

( * ) Notice: Subject to any disclaimer, the term of this patent is extended or adjusted under 35 U.S.C. 154(b) by 767 days.

(21) Appl. No.: 16/071,838

(22) PCT Filed: Jan. 25, 2017

(86) PCT No.: PCT/EP2017/051571
§ 371 (c)(1),
(2) Date: Jul. 20, 2018

(87) PCT Pub. No.: WO2017/129632
PCT Pub. Date: Aug. 3, 2017

(65) Prior Publication Data

US 2021/0102437 A1 Apr. 8, 2021

(30) Foreign Application Priority Data

Jan. 25, 2016 (GB) ..... 1601321

(51) Int. Cl.
*E21B 33/068* (2006.01)

(52) U.S. Cl.
CPC ..... *E21B 33/068* (2013.01)

(58) Field of Classification Search
CPC ..... E21B 33/068; E21B 33/03
See application file for complete search history.

(56) References Cited

U.S. PATENT DOCUMENTS 2,250,244 A 7/1941 Yancey
2,552,901 A 5/1951 Miller
(Continued)

FOREIGN PATENT DOCUMENTS

GB 2 030 620 A 4/1980
GB 2 480 371 A 11/2011
(Continued)

OTHER PUBLICATIONS

International Search Report of International Application No. PCT/EP2017/051571 dated May 26, 2017, 4 pages.
(Continued)

*Primary Examiner* — Nicole Coy
*Assistant Examiner* — Yanick A Akaragwe
(74) *Attorney, Agent, or Firm* — Getz Balich LLC

(57) ABSTRACT

A tool for gaining lateral access to a well via a lateral access passage includes a head portion. The tool axially forwardly advances the head portion towards the lateral access passage and transmits rotational drive to the head portion. The tool delivers fluid to or forwardly of the head portion. The head portion may have an adapter at its front end for interchangeable attachments, such as a sealing device, a socket member, or a cleaning brush. The tool may include a flexible conduit extending forwardly of the head portion. A curved guide passage may be provided to guide a fluid transmission conduit of the tool as it advances forwardly. The tool may have a shaft for forwardly advancing the head portion, the shaft being coupled to a rotatable drive member configured to be rotatably driven such that rotation of the rotatable drive member causes axial forward movement of the shaft.

20 Claims, 27 Drawing Sheets

(56) References Cited

U.S. PATENT DOCUMENTS

| | | | | |
|---|---|---|---|---|
| 3,076,513 | A * | 2/1963 | Heaphy | E21B 7/00 173/49 |
| 3,277,964 | A | 10/1966 | Houpeurt et al. | |
| 3,965,977 | A * | 6/1976 | Beson | E21B 33/047 166/88.4 |
| 4,181,175 | A | 1/1980 | McGee et al. | |
| 4,268,283 | A | 5/1981 | Roberts | |
| 4,356,582 | A * | 11/1982 | Stephenson | E04H 4/1681 134/167 R |
| 6,050,338 | A | 4/2000 | Watkins | |
| 6,289,992 | B1 | 9/2001 | Monjure | |
| 6,470,971 | B1 * | 10/2002 | Bridges | E21B 34/02 166/379 |
| 2004/0206508 | A1 | 10/2004 | Chan et al. | |
| 2005/0279512 | A1 | 12/2005 | Boyd | |
| 2010/0018721 | A1 * | 1/2010 | Jennings | E21B 19/22 166/385 |
| 2010/0314097 | A1 * | 12/2010 | Jennings | G01B 17/00 166/65.1 |
| 2010/0319933 | A1 * | 12/2010 | Baugh | E21B 21/00 166/381 |
| 2011/0278007 | A1 | 11/2011 | Howell et al. | |
| 2012/0241174 | A1 | 9/2012 | Langeteig | |
| 2013/0284445 | A1 | 10/2013 | Hughes | |
| 2014/0053874 | A1 * | 2/2014 | Mackenzie | E21B 19/22 134/22.12 |
| 2015/0376977 | A1 | 12/2015 | Nguyen et al. | |

FOREIGN PATENT DOCUMENTS

| | | | |
|---|---|---|---|
| WO | WO 03/046329 | A2 | 6/2003 |
| WO | WO 2009/123805 | A2 | 10/2009 |
| WO | WO 2011/071389 | A1 | 6/2011 |
| WO | WO 2012/022987 | A2 | 2/2012 |

OTHER PUBLICATIONS

UK Search Report of British Application No. 1601321.1 dated Aug. 30, 2016, 6 pages.

European Search Report of Related EP 20190889 dated Dec. 7, 2020, 12 pages.

EP search report for EP21182557.5 dated Oct. 20, 2021.

* cited by examiner

WELL ACCESS TOOL

BACKGROUND

The present invention relates to a tool for gaining lateral access to a well, such as a well head of a well, and to methods for gaining lateral access to a well.

Wells often have at least one lateral access passage which provides for communication between the inside of the well and the outside. The lateral access passage may consist of a side opening in a well wall, together with a passageway radially outwardly of the side opening. The radially outer passageway extends through a valve projecting radially from the well wall. The valve may be opened to allow communication between the side wall and further radially outward components.

The side openings in some well walls include an internal thread and these provide the option of closing the side opening using a plug which screws into the thread and forms a pressure tight seal.

It is known to provide a tool for gaining lateral access to a well via the passageway through an opened valve in order to screw in or unscrew a plug in the well side opening. The known system involves the use of a telescopic hydraulically operated tool having at its forward end a socket head. The plug has at its rear a hexagonal portion for engagement in the socket head and providing a torque transmitting connection between the socket head and the plug, and forwardly of the hexagonal portion, an annulus into which the socket member can latch.

In a situation where it is desired to screw a plug into the well side opening, the tool is used by mounting a plug on the socket head and then advancing the socket head along the valve passageway until it lands against the well wall. The socket head is rotated to screw the plug into the side opening. The socket member may then be retracted and the tool removed, leaving the plug in place.

If it is later desired to remove the plug then the hydraulic tool is brought into use again. The socket head is advanced forwardly through the passageway until it engages and latches. Once the socket member is latched on it may be rotated to unscrew the plug and then withdrawn to carry the plug rearwardly and out of the passageway.

When the plug is in place and provides a pressure tight sealed closure, the valve on the side of the well, radially outwardly of the now plugged side opening in the well wall, may be removed for servicing or replacement.

Another situation in which it is desirable to gain lateral access to a well arises when remedial work is to be done inside the well. For example, a tubing hanger inside a wellhead may develop a fault in which it does not seal properly to the wellhead wall. A problem in a seal may arise above or below a side opening in the wellhead wall. In this situation it may be desired to gain access to the wellhead via a passageway in a valve and the side opening in the wellhead wall in order to inject a sealant to the leaking region. A sealant injection member may be advanced through the passageway in the valve and through the side opening, so that it may then discharge sealant into the interior of the wellhead. The sealant may be tailored either to "float" or "sink" so that it reaches the region where a leak has developed.

SUMMARY

A problem with such a method is that it is difficult to prevent the sealant from spreading into the wellhead side opening or into the passageway through the valve, then making it difficult to re-plug the side opening or to close the valve after the remedial sealing operation has been completed. It can also be difficult for the sealant to reach places in the wellhead remote from the side opening.

According to a first aspect, the invention provides a tool for gaining lateral access to a well via a lateral access passage, the tool comprising a head portion and being configured to axially forwardly advance the head portion towards or in the lateral access passage and being configured to transmit rotational drive to the head portion, and the tool comprising a fluid transmission conduit for delivering fluid to or forwardly of the head portion.

Such a tool has the combined functionality of being able to transmit rotational drive to the head portion, for example to turn a socket member in order to install or remove a plug in a well side opening, as well as being able to deliver fluid to the head portion.

It can therefore be used in a first mode in which it is used to transmit rotational drive to the head portion, for example to screw in or unscrew a plug, by providing the head portion with a suitable socket member. The socket member may have a socket for engaging a component for rotation thereof, such as a plug. The rotational drive may also be used to rotate a cleaning device such as a brush provided on the head portion, for example to clean the inside of a side opening, in particular to clean threads of the side opening.

The tool can also be used in a second mode in which it delivers fluid to the head portion. This may be useful for example to deliver fluid in the form of sealant to the head portion, which may be provided with a suitable fluid outlet such as a nozzle. It may also be useful to deliver cleaning fluid, for example to clean the inside of a side opening, in particular the threads.

The same tool may thus be used in different modes of operation, avoiding the need for different tools to be made available.

In some uses the fluid delivery and the rotational drive may be carried out at separate times. In other uses, the fluid delivery and the rotational drive may be carried out at the same time. For example, a brush may be rotationally driven whilst cleaning fluid may be simultaneously delivered, enhancing the cleaning effect.

A third mode of operation may also be provided, namely axial reciprocation of the head portion. Thus the tool may be configured to transmit forward or rearward drive to the head portion. An example of the use of this mode is the reciprocation of a cleaning brush. In one possible use, rotational drive, reciprocating axial drive and fluid delivery may be carried out at the same time.

The lateral access passage of the well may comprise a side opening in a well wall in combination with a passageway radially outwardly of the well wall, which may be a passageway through a valve.

The fluid transmission conduit may be arranged to be rotationally driven. The tool may be configured to transmit rotational drive to the fluid transmission conduit. The fluid transmission conduit may then transmit the rotational drive to the head portion. The fluid transmission conduit may comprise a pipe. Such a pipe may serve to impart rotational drive to the head portion, and it may serve to transmit fluid to the head portion.

The head portion may comprise an adapter for removably mounting an attachment. The head portion may comprise various interchangeable attachments. The attachment may for example be a socket member, a sealing device or a brush.

In the embodiments where the fluid transmission conduit comprises a pipe, the head portion may be connected to the pipe. In some embodiments, the head portion comprises an adapter in the form of a pipe connector. The head portion may for example be welded to the pipe, although in alternative embodiments it may be removably connected to the pipe.

The fluid transmission conduit may comprise a first fluid passageway arranged to deliver fluid to the head portion, and a second fluid passageway in the head portion. The tool may comprise a valve, such as a check valve, between the first fluid passageway and the second fluid passageway. A check valve can allow fluid, such as a sealant or a cleaning fluid, to flow from the first fluid passageway to the second fluid passageway, whilst preventing flow from the second fluid passageway to the first fluid passageway. In the embodiments where the fluid transmission conduit comprises a pipe, the first fluid passageway may be provided in the pipe and the second fluid passageway may be provided in the head portion.

The tool may comprise a shaft for forwardly advancing the head portion by axial forward movement of the shaft, the shaft being coupled to a rotatable drive member configured to be rotatably driven such that rotation of the rotatable shaft causes axial forward movement of the shaft. Further features of the shaft are discussed below in relation to a third aspect of the invention, and such further features are also applicable to the first aspect, or indeed any other aspect, of the invention.

The head portion may have a sealing device for forming a seal with the lateral access passage and an outlet for discharging fluid forwardly of the seal. Further features of the sealing device are discussed below in relation to a second aspect of the invention, and such further features are also applicable to the first aspect, or indeed any other aspect, of the invention.

The head portion may be configured to hold the fluid transmission conduit for forward advancement therewith and the tool may comprise a flexible conduit portion extending forwardly of the head portion. Further features of the flexible conduit portion, and of a curved guide passage for guiding the flexible conduit portion, are discussed below in relation to the second aspect of the invention, and such further features are also applicable to the first aspect, or indeed any other aspect, of the invention.

The invention also extends to methods of using the tool of the first aspect of the invention to gain lateral access to a well via a lateral access passage. A method may comprise operating the tool to forwardly advance the head portion towards the lateral access passage, and operating the tool to transmit rotational drive to the head portion and/or to deliver fluid via the fluid transmission conduit to or forwardly of the head portion. The tool has the capability to transmit rotational drive to the head portion and the capability to deliver fluid to or forwardly of the head portion, and so on a given job just one of these functions may be carried out. Alternatively, a job may require that both of these functions are carried out, and they may then be carried out in sequence or simultaneously.

According to the second aspect the invention provides a tool for gaining lateral access to a well via a lateral access passage, the tool comprising a head portion and being configured to axially forwardly advance the head portion towards or in the lateral access passage, and the tool comprising a fluid transmission conduit for delivering fluid to or forwardly of the head portion, wherein: the head portion has a sealing device for forming a seal with the lateral access passage and an outlet for discharging said fluid forwardly of the seal; or the head portion is configured to hold the fluid transmission conduit for forward advancement therewith and the tool comprises a flexible conduit portion extending forwardly of the head portion.

According to the second aspect, the tool can be used to gain access to a well via a lateral access passage and then to deliver fluid, such as a sealant, to where it is desired.

By providing a sealing device for forming a seal with the lateral access passage and an outlet for discharging fluid forwardly of the seal, it is possible to isolate the lateral access passage, or at least a portion thereof to the rear (radially outwardly with respect to the well) thereof, from the region forwardly (radially inwardly) of the seal.

As mentioned above in relation to the first aspect of the invention, the lateral access passage of the well may comprise a side opening in a well wall in combination with a passageway radially outwardly of the well wall, which may be a passageway through a valve.

The seal may be formed against a valve passageway which leads radially outwardly from a well wall, isolating the valve passageway from the fluid but not isolating the side opening in the well wall. Alternatively the seal may be formed against the side opening in the well wall, isolating both the side opening and the passageway from the fluid.

The fluid may be a sealant, for example to fix a seal between a tubing hanger and the well wall, in the so-called "third annulus". The sealant may be formulated to float in the well fluids, so as to rise upwardly and provide sealant to the region above the side opening, or it may be formulated to be denser than the well fluids so as to sink and assist with sealing in a region below the side opening.

The fluid may be a cleaning fluid.

Related to the second aspect, the invention also provides a method of gaining lateral access to a well via a lateral access passage, comprising forwardly advancing a sealing device into the lateral access passage, expanding a sealing member of the sealing device radially outwardly so as to form a seal with the lateral access passage, and discharging fluid forwardly of the seal.

The sealing device may comprise a circumferentially extending sealing member and first and second end members, one at each axial end of the sealing member, the first and second end members being configured to be urged axially towards each other, so as to cause the sealing member to expand radially outwardly and form said seal with the lateral access passage.

Each end member may for example be in the form of a simple washer.

The tool may have a shaft arranged to be axially forwardly moved or retracted. The tool may be configured so that axial forward movement of the shaft urges the first and second end members axially towards each other. This may then cause the radial expansion of the sealing member to form the seal with the lateral access passage.

Thus, in use of certain embodiments, the shaft may be axially forwardly advanced to insert the head portion in the lateral access passage, and when a certain point is reached further axial forward movement of the shaft urges the first and second members axially towards each other. This may rely on the end member in front of the sealing member reaching a point in its advancement where it is arrested. This point may for example be at the radially inner end of a passageway through a valve disposed radially outwardly of a well wall side opening, where the diameter of the side opening is less than that of the passageway so as to provide a shoulder against which the end member is arrested. The point may alternatively be at or near a radially inner end of the well wall side opening. The front end member may then be arrested by engagement of the head portion with a tubing hanger. With this latter arrangement the seal can be formed with the side opening at its radially inner end, so that the entire side opening and valve passageway may be advantageously isolated from the outlet where fluid is discharged forwardly of the seal.

The outlet may face in a sideways direction with respect to the axis of the tool. This can ensure that it will not be obstructed by anything, such as a tubing hanger, which arrests the forward advancement of the head portion.

According to a method of using the tool of the second aspect of the invention, or any other aspect in which the tool has a flexible conduit portion, the flexible conduit portion may be forwardly advanced along the lateral access passage of a well, and with continued advancement, its front end may follow a path around a well annulus radially internally of the lateral access passage.

The invention also provides a method of gaining lateral access to a well via a lateral access passage, comprising forwardly advancing a flexible conduit portion along the lateral access passage, deviating a front end of the flexible conduit portion around a well annulus radially internally of the lateral access passage, and delivering fluid via the flexible conduit portion into the well annulus at a location circumferentially spaced from the lateral access passage.

Thus, the flexible conduit portion may be used to gain access in a well annulus at places not immediately adjacent to the radially inner end of the lateral access passage, i.e. at more remote parts around the annulus, including as far as the diametrically opposite side of the annulus.

The tool may have a nozzle at the front end of the flexible conduit portion. This can be used to deliver fluid, for example to deliver sealant into a well annulus.

The flexible conduit portion may be provided with a convex front surface. This can cause the flexible conduit portion to move around a well annulus after it has struck a radially inner wail of the annulus during its forward advancement.

The flexible conduit portion may comprise a helically wound wire with an internal axially extending passage. A suitable helically wound wire, providing longitudinal flexibility, may be a sewer cable.

The flexible conduit portion may comprise a fluid containing material such as a plastics material. Such a construction can serve to contain fluid and deliver it along the length of the flexible conduit portion. The flexible conduit portion may have a helically wound wire and a fluid containing material.

The tool may comprise a curved guide passage for guiding the flexible conduit portion in a curved path towards the lateral access passage. Such a curved guide passage is described in further detail below in relation to the fourth aspect of the invention.

In order to assist the flexible conduit portion in advancing forwardly, a flexible conduit guide member may be used. Such a flexible conduit guide member may provide a guide passage through which the flexible conduit portion may extend. The flexible conduit guide member may assist in preventing the flexible conduit portion from catching on any obstructions as it moves forwardly, such as when it reaches a change of diameter of the lateral access passage from a larger to a smaller diameter. The flexible conduit guide member may at its front end be directed sideways with respect to the direction of forward movement of the flexible conduit portion, to assist in deviating the latter sideways when reaching e.g. a well annulus.

The flexible conduit guide member may be advanced forwardly to adopt a position at the front of the lateral access passage, e.g. adjacent to a well annulus.

The flexible conduit guide member may be advanced forwardly in the lateral access passage, for example by being held by the head portion and advanced forwardly therewith, in a manner similar to the advancement of the plug for the well side opening. It may then be released by the head portion, which is then retracted, leaving the flexible conduit guide member in place for later insertion of the flexible conduit portion. Alternatively, the flexible conduit guide member and the flexible conduit portion could be initially together advanced into the lateral access passage, with the flexible conduit portion then being further advanced with respect to the guide member.

In the second aspect, or any other aspect, of the invention the tool may be configured to rearwardly retract the head portion. This functionality can be used to retract the head portion from the lateral access passage after an appropriate operation, such as sealing, cleaning, or inserting or removing a plug, has been completed.

If a wellhead side wall is plugged and a leak has developed between the tubing hanger and the side wall, in prior art methods it is necessary first to use a tool such as the hydraulically operated tool described in order to remove the plug, and then to use a different tool to deliver sealant into the wellhead to effect the repair. This involves cost in view of the need to have two tools at the site and complexity in the need for users to operate the different tools.

According to a third aspect, the invention provides a tool for gaining lateral access to a well via a lateral access passage, the tool comprising a head portion and being configured to axially forwardly advance the head portion towards or in the lateral access passage and being configured to transmit rotational drive to the head portion, and the tool comprising a shaft for forwardly advancing the head portion by axial forward movement of the shaft, the shaft being coupled to a rotatable drive member configured to be rotatably driven such that rotation of the rotatable drive member causes axial forward movement of the shaft.

The tool can be used to transmit rotational drive to the head portion, for example to screw or unscrew a plug in a well side opening or to rotate a cleaning brush. The shaft for forwardly inserting the head portion is coupled to a rotatable drive member configured to be rotatably driven such that rotation of the rotatable drive member causes axial forward movement of the shaft. Thus, the system does not rely on hydraulic pressure to cause axial forward movement of the shaft, with the potential risk of hydraulic pressure failure.

The coupling between the shaft and the rotatable drive member may be such that axial force on the shaft, for example caused by well pressure acting to push the head portion rearwardly, does not cause the rotatable drive member to rotate. This then prevents the shaft from axial rearward movement under the pressure. Thus, the coupling may be self-locking.

The shaft may be coupled to the rotatable drive member by an internally threaded member, such as a nut, mounted on an external thread of the rotatable drive member, the internally threaded member being prevented from rotation whereby rotation of the rotable drive member causes axial movement of the internally threaded member which is transmitted to the shaft.

With such an arrangement, if there is an external force applied to the shaft, for example well pressure acting to push it rearwardly, the axial rearward force is transmitted to the internally threaded member, e.g. the nut, and the thread of the internally threaded member then urges the thread of the rotatable drive member rearwardly, but this does not result in rotation of the rotatable drive member. The mounting of the internally threaded member on the rotatable drive member effectively permits rotation of the drive member to cause axial movement of the internally threaded member, but prevents an axial force applied to the internally threaded member from causing rotation of the drive member. This provides a self-locking arrangement.

The tool may have an axial facing drive portion mounted to the internally threaded member and arranged to engage an axially facing driven portion mounted to the shaft for transmitting the axial movement of the internally threaded member, caused by rotation of the rotatable drive member, to the shaft. The axial facing axial drive portion may be provided by an internal face of a recess, e.g. a radial recess, or an external face of a projection, e.g. a radial projection. A plurality of axial facing axial drive portions, e.g. recesses, may be provided.

The axially facing driven portion mounted to the shaft may be provided by an internal face of a recess, e.g. a radial recess, or an external face of a projection, e.g. a radial projection. A projection may be in the form of a finger. A plurality of driven portions, e.g. fingers, may be provided. Thus there may be a castellation of fingers.

In the third aspect of the invention, or in embodiments of other aspects of the invention described herein, the tool can be used to transmit rotational drive to the head portion, for example to screw or unscrew a plug in a well side opening or to rotate a cleaning brush. Where a shaft for forwardly advancing the head portion is provided, and where a rotatable drive member is provided, the shaft may comprise first and second shaft members.

The first shaft member may be arranged to be caused to move axially forwardly when the rotatable drive member is rotated, the head portion may be connected to the second shaft member, and the second shaft member may be axially movable with the first shaft member and be rotatable relative thereto so it can be driven to transmit rotational drive to the head portion.

Thus, the first shaft member and the second shaft member may be forwardly advanced by rotation of the rotatable member, for example to engage a socket member of the head portion on a plug, or to position a brush inside a well wall side opening, and then the second shaft member may be rotationally driven to rotate the head portion. The socket member or the brush may thus be rotated.

The second shaft member may extend coaxially with and at least partly within the first shaft member.

The second shaft member may be provided with an external thread, a bushing may be axially fixed with respect to the first shaft member and may be provided with an internal thread engaged with the external thread of the second shaft member, and a switch may be arranged to rotationally lock the bushing to the first shaft member so that it cannot rotate relative thereto or to rotatably unlock the bushing from the first shaft member so that it can rotate relative thereto.

The engagement of the threads of the bushing and the second shaft member allows the second shaft member to move axially with the first shaft member. The second shaft member may be driven for rotation without axial movement relative to the first shaft member by rotationally unlocking the bushing from the first shaft member and thereby allowing the bushing to spin with the second shaft member. If the bushing is rotationally locked to the first shaft member, rotation of the second shaft member will also result in it moving axially with respect to the first shaft member.

The second shaft member may be a fluid transmission conduit, e.g. a pipe, such as an inner pipe. It may alternatively be a solid rod which will allow a greater torque to be transmitted to the head portion but will not provide for fluid transmission.

According to a fourth aspect the invention provides a tool for gaining lateral access to a well via a lateral access passage, the tool comprising a head portion and a drive mechanism for axially forwardly advancing the head portion towards or in the lateral access passage, wherein the tool has an elongate transmission member for transmitting rotational drive to the head portion and/or for delivering fluid via a fluid transmission conduit to or forwardly of the head portion, and wherein the tool comprises a curved guide passage for guiding the elongate transmission member in a curved path between the drive mechanism and the lateral access passage of the well.

In some circumstances there is a restricted amount of space adjacent to a well where lateral access is required through a lateral access passage. If the tool of the various aspects of the invention discussed herein is arranged with its general axis extending radially with respect to the well, there may be insufficient space, particularly if the operation being carried out on the well requires the tool to have a larger stroke length. It may therefore be beneficial to use a tool of the fourth aspect of the invention, having a curved guide passage for guiding an elongate transmission member in a curved path between the drive mechanism and the lateral access passage of the well. This can permit the drive mechanism to be arranged along an axis which is different from a radial direction with respect to the well.

The elongate transmission member is capable of transmitting rotational drive as well as being guided in a curved path. It may be made of a known cable type, such as a sewer cable or a drain snake. The elongate transmission member may have an inner core and an outer cable portion.

The elongate transmission member may be used to screw or unscrew a nut, or to rotate a brush, for example.

The elongate transmission member may also provide for fluid transmission, as well as rotational drive transmission. It may thus be part of a fluid transmission conduit as described elsewhere herein. Further, the fluid transmission conduit comprising the elongate transmission member may also comprise a flexible conduit portion as described herein.

The elongate transmission member may thus comprise a helically wound wire with an internal axially extending passage. It may comprise a fluid containing material such as a plastics material. It may be a polymer and steel composite hose of the type described in WO 2012/022987. It may be a helical wire, for example a sewer cable having an internal axially extending passage, and adapted to contain fluid by being externally or internally coated with a fluid containing material such as a plastics material.

A straight guide passage may be provided between the drive mechanism of the tool and the curved guide passage. Such a straight guide passage may be used so that a shaft of the tool, as described elsewhere herein, can be axially forwardly advanced in the straight guide passage. The shaft need not enter the curved guide passage. Thus the straight guide passage may be of sufficient length to allow the full required stroke of the shaft. At its front end the shaft may be connected to the elongate transmission member. When the shaft is in a rear position, the elongate transmission member may lie at least partly along the length of the straight guide passage. When the shaft is in a forward position, the elongate transmission member may have been advanced mostly out of the straight guide passage, extending through the curved guide passage towards the well.

As described herein, the head portion may comprise a socket member for engaging a plug, or a sealing device, or a brush. Such a head portion may be arranged at a forward end of the curved guide passage, so that when the head portion is advanced forwardly it does not have to be guided around the curved guide passage. The elongate transmission member may then be connected to the rear of the head portion for transmitting rotational drive to the head portion and/or for delivering fluid via a fluid transmission conduit to or forwardly of the head portion. The head portion itself can also be forwardly advanced (or retracted) by the elongate transmission member. The head portion may follow a straight path during this advancement.

According to a fifth aspect the invention provides a tool for gaining lateral access to a well via a lateral access passage, the tool comprising a head portion and being configured to axially forwardly advance the head portion towards or in the lateral access passage, wherein the tool is configured to transmit rotational drive to the head portion and/or has a fluid transmission conduit for delivering fluid to or forwardly of the head portion, and wherein the tool has a housing comprising a plurality of housing portions axially connected together and having a first length, wherein at least one of the housing portions is disconnectable and removable so that the remaining housing portions can form the housing with a second length shorter than the first length.

For some wells having longer lateral access passages, the tool may require a longer stroke length, i.e. the distance over which the head portion is moved from a retracted position to a landing position. On the other hand, for many wells there may be a limited amount of space radially outwardly of the well for location of the tool. A shorter tool can fit into a smaller radial space outwardly of the well but will normally have a shorter stroke length.

By using the tool according to the fifth aspect of the invention, a longer stroke length can be provided by connecting the housing portions axially together, but if there is insufficient space and a shorter stroke length is acceptable, then one of the housing portions may be removed.

There may be a front housing portion, a rear housing portion, and at least one intermediate housing portion. To shorten the housing, one or more of the intermediate housing portions may be disconnected and removed. Then the housing portions which were previously on each end of the removed intermediate portion(s) may be connected to each other to form the shorter housing.

Thus the tool provides a modular system in which the user can choose the arrangement to use depending on the conditions.

One or more intermediate housing portions may be provided. Thus an embodiment may comprise a front housing portion axially connected to a first intermediate housing portion, a second intermediate housing portion axially connected to the first intermediate housing portion, and a rear housing portion axially connected to the second intermediate housing portion.

The various optional features discussed above and herein may be applicable to any or all of the aspects of the invention.

The head portion may comprise an adapter to mount an attachment. In embodiments where the fluid transmission conduit comprises a pipe, the adapter may comprise a pipe connector. The pipe connector may for example be welded to the pipe. Attachments may be interchangeable. Examples of attachments are a sealing device for forming a seal with the lateral access passage, a socket member for holding a plug, and a cleaning brush.

Certain preferred embodiments of the invention will now be described by way of example and with reference to the accompanying drawings, in which:

DETAILED DESCRIPTION

Figure 1:
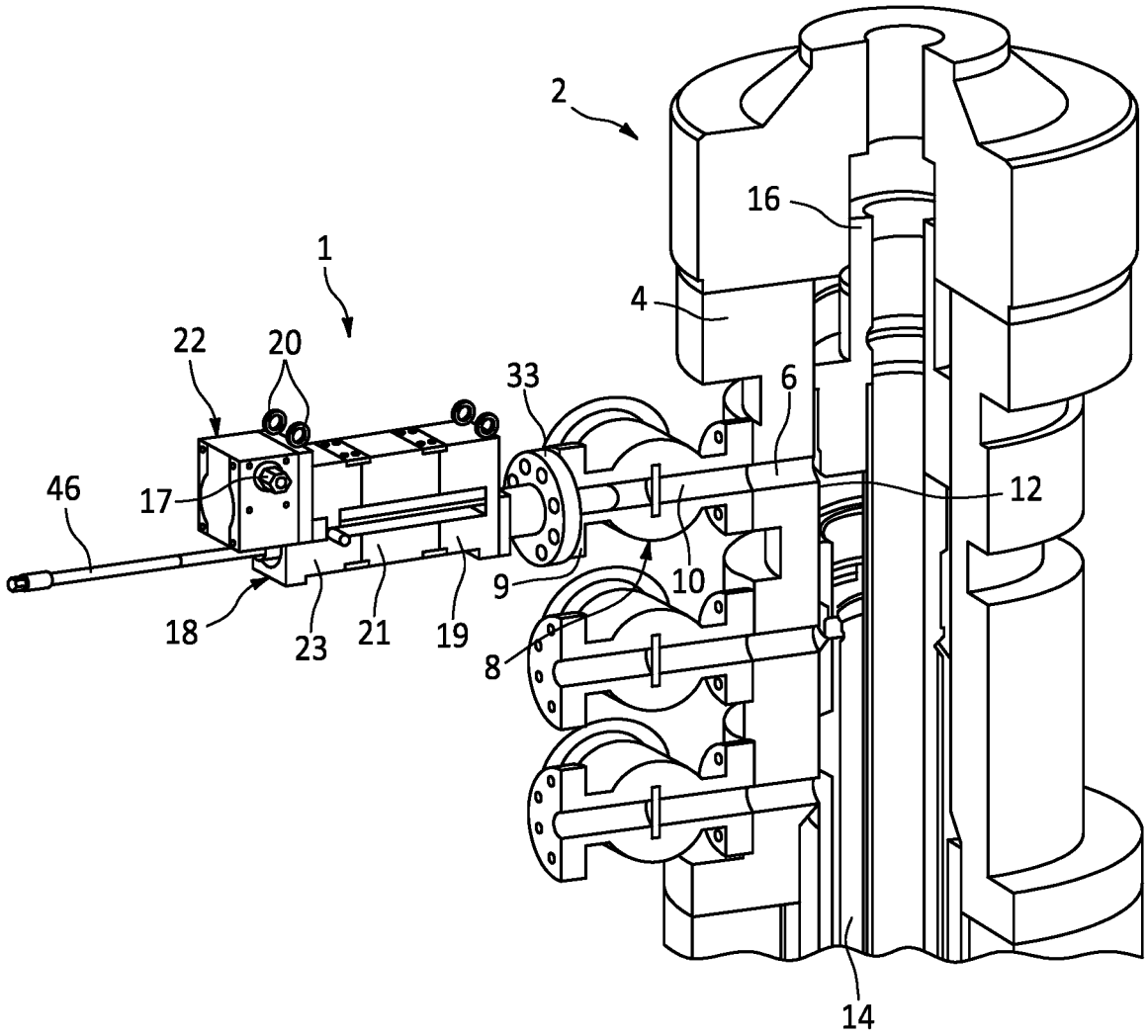
FIG. 1 is a perspective view showing an embodiment of a tool in accordance with the present invention connected to a well head, the well head being shown partly cut away.

FIG. 1 shows apparatus comprising a tool 1. The tool 1 is connected to a wellhead 2. The wellhead 2 has an annular outer wall 4 formed with a side openings 6 and a valve 8 having therethrough a passageway 10 which is aligned with the side opening 6 in the outer wall 4.

The passageway 10 and the side opening 6 together form a lateral access passage, which provides access to the outside of the outer wall 4, the inside of the side opening 6, or the space radially inwardly of the side opening.

The valve has a radially outer flange 9. The wellhead 2 has an annular cavity 12, known as the annulus, between a radially inner well production tubing 14 and the inside surface of the outer wall 4. The production tubing 14 is supported by a tubing hanger 16 which is in sealed engagement with the inside surface of the outer wall 4.

The wellhead 2 is of a standard construction. The valve 8 is normally a gate valve, which when closed shuts off access from the outside to the wellhead side opening 6. In some known designs of wellhead, the side opening 6 includes a thread able to receive a plug. In these systems, the plug closes the side opening and seals the annular cavity 12 from the valve 8. This can allow the valve 8 to be removed and replaced if desired. When is it desired to gain access to the annulus 12, the valve 8 is opened and a tool is inserted through the valve passageway 10 to engage with a hexagonal head of the plug to unscrew it. The tool latches onto the hexagonal head with the aid of a circumferential groove in the head and so is able to withdraw the plug once unscrewed. Thus, access to the annulus via the side opening 6 is achieved. The system also allows for the plug, or a replacement plug, to be passed along the valve passageway whilst held by the tool and then screwed into position in the side opening 6.

The tool 1 will now be described with reference to FIGS. 2-9. The tool comprises a housing 18 formed in three parts split generally along a vertical plane perpendicular to the fore and aft or axial direction of the tool (which in use corresponds to the radial direction of the well). The housing 18 has a front housing portion 19, an intermediate housing portion 21 and a rear housing portion 23. The front housing portion 19 is attached to the intermediate housing portion 21 by an upper plate 25 and a lower plate 27, each plate being attached to the adjoining housing portion by screws 29. A similar connecting arrangement is provided between the intermediate housing portion 21 and the rear housing portion 23.

The front housing portion 19 and the rear housing portion 23 each have a pair of lateral spaced carrier rings 20 on their respective upper surfaces. The front housing portion 19 provides a front wall 31 of the housing. At a rear end of the housing, i.e. the end which is radially outward with respect to the radial direction of the wellhead in use, a gearbox 22 is secured. The gearbox has an input shaft 17 (see FIG. 1) to which may be connected a torque wrench. The gearbox is part of a screw jack, described further below.

At the front end of the tool 1, i.e. the radially inner end with respect to the wellhead when the tool is in use, a front adapter assembly 24 is secured. The front adapter assembly is provided with a flange 33 having a plurality of bolt holes 26 which are used to bolt the tool 1 to the radially outer flange 9 of the valve 8 of the wellhead, as seen in FIG. 1. An annular recess 35 (see FIG. 5) is provided on the front face of the flange 21 for receiving a seal (not shown) for sealing between the two flanges.

On one side of the housing 18 a longitudinally extending window 28 is provided. A ruler 37 is fastened to the outside of the housing above and adjacent to the window 28. A tell tail 30 projects from the inside of the housing 18 through the window 28 and has at its outer end a pointer 32 (see FIG. 10 for an enlarged view) disposed in close proximity to the ruler 29.

As can be seen in FIGS. 1-5, a ferrule assembly 34 projects forwardly from the front adapter assembly 24.

Figure 2:
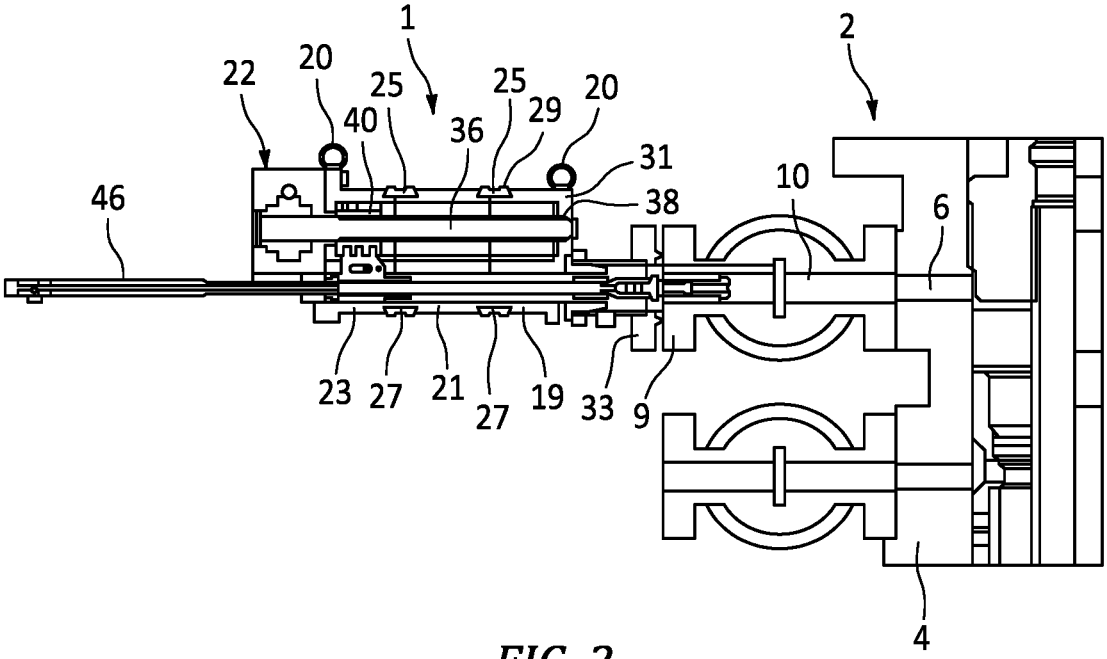
FIG. 2 is a longitudinal sectional view of the apparatus shown in FIG. 1.
Figure 3:
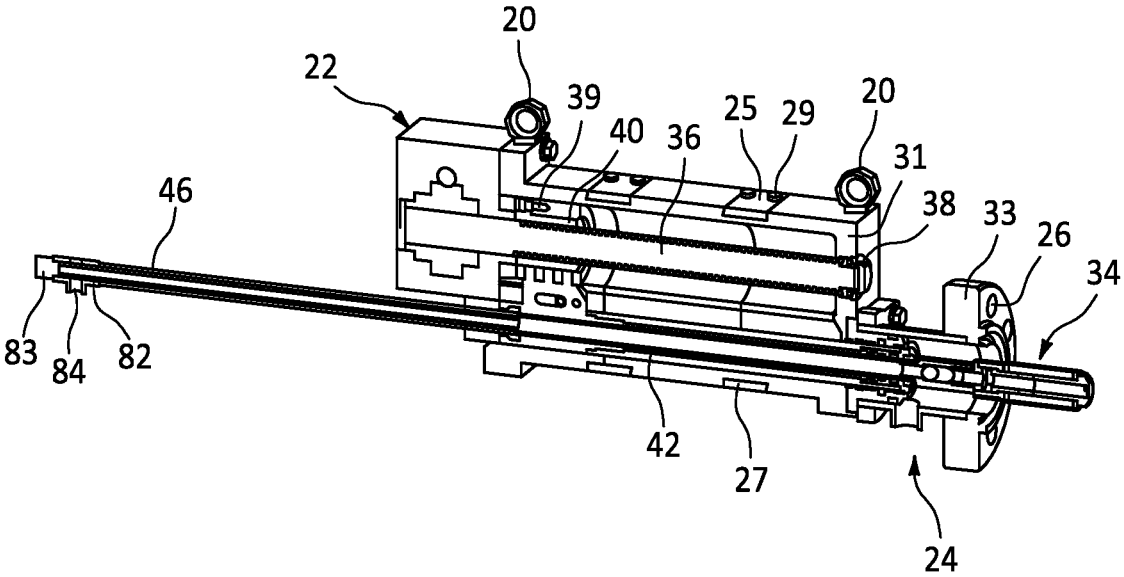
FIG. 3 is a cut away view showing a longitudinal section of the tool, taken in a vertical plane.
Figure 4:
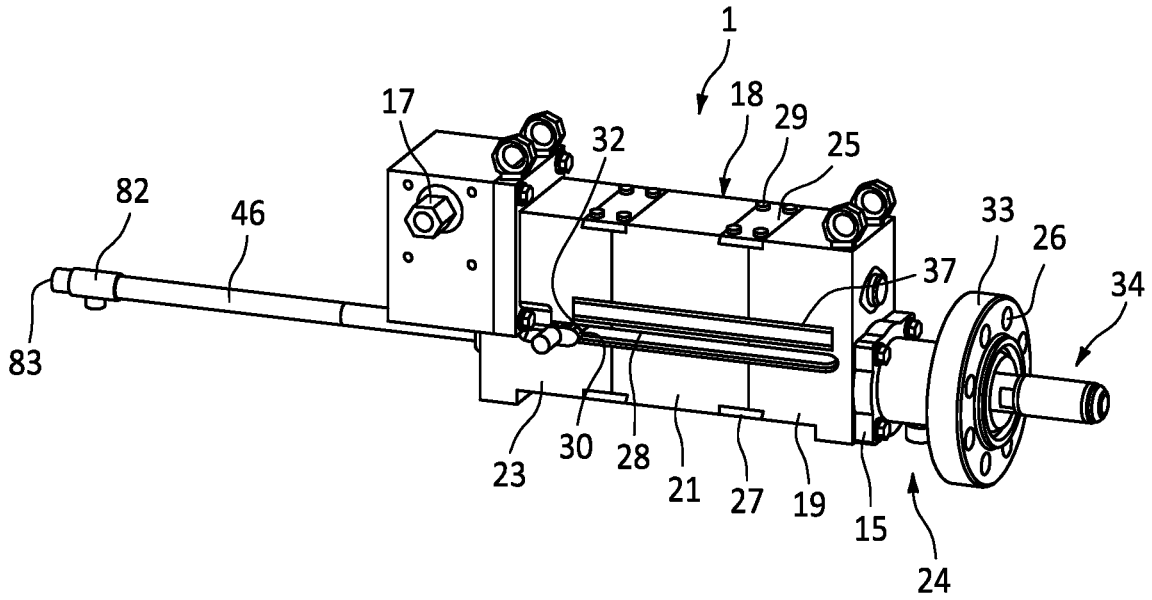
FIG. 4 is a perspective view of the tool.
Figure 5:
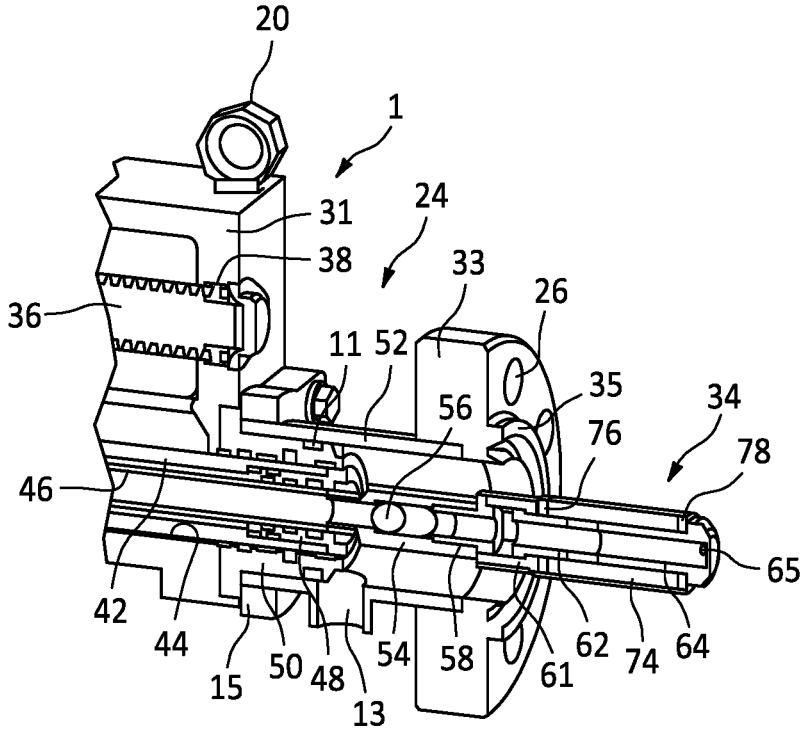
FIG. 5 is a cut away view of a front part of the tool.

FIGS. 2, 3 and 5 show some of the internal details of the tool 1. The screw jack includes the gear box 22 with the input shaft 17. The gear box 22 has a longitudinally extending output shaft 36 formed with an external screw thread. The output shaft 36 is supported for rotation at its forward end by a bearing assembly 38 secured to the front wall 19 of the housing 18. It provides a rotatable drive member which when rotatably driven causes axial forward or rearward movement of a shaft 42.

An internally threaded nut 40 of the screw jack engages with the external thread of the output shaft 36. A sleeve 41 is mounted on the nut 40 and is fixed thereto by a screw 39, which holds a forward facing annular flange of the nut axially against a rear facing annular surface of the sleeve. The sleeve is formed with three downwardly directed radial holes 43 in which are loosely received a castellation 45 comprising three upward projections 47. The nut 40 is prevented from rotation by the interengagement of the castellation 45 in the radial holes 47 of the sleeve 41, so that when the gearbox output shaft 36 is rotated the nut moves longitudinally along the shaft.

The castellation 45 is part of an axially drivable assembly 49 mounted to a rear end of the shaft 42. When the assembly 49 is axially driven forwardly or rearwardly by movement of the nut 40 on the shaft 36 transmitted to the castellation 45, it causes forward or rearward movement of the shaft 42.

The axially drivable assembly 49 comprises a split sleeve 51 screwed together in a horizontal mating plane by a plurality of screws 53. A tower 55 is mounted on the upper half of the split sleeve 51. The tower is provided with a horizontal hole 57 into which is mounted an end of the tell tale 30. A bushing 59 having an internal thread (not shown) is mounted at the rear end of the axially drivable assembly 49, captured between the two halves of the split sleeve 51. The bushing 59 has a circular flange 61 at its rear end which is received in a circular groove 63 formed internally near the rear end of the split sleeve 51. The engagement of the flange 61 in the groove 63 ensures that the nut cannot move relative to the rest of the axially drivable assembly 49. The bushing 59 can however be locked to the rest of the assembly by a switch device 67. The switch device 67 has a pair of laterally spaced and axially extending fingers 69 which are received in corresponding slots 71 on opposite sides of the tower 55.

The opposed slots 71 are connected by an elongate aperture 73. A pin 77 passes through a pair of openings formed in the fingers 69 and also passes through the elongate aperture 73. At the rear of the fingers 69 a lock member 81 is formed on its lower face with a pair of angled surfaces (not shown) formed to correspond to two adjacent surfaces of a rear hexagonal part 80 of the bushing 59. A knob 85 is provided at one end of the pin 77 and is accessible by a user.

Figure 9:
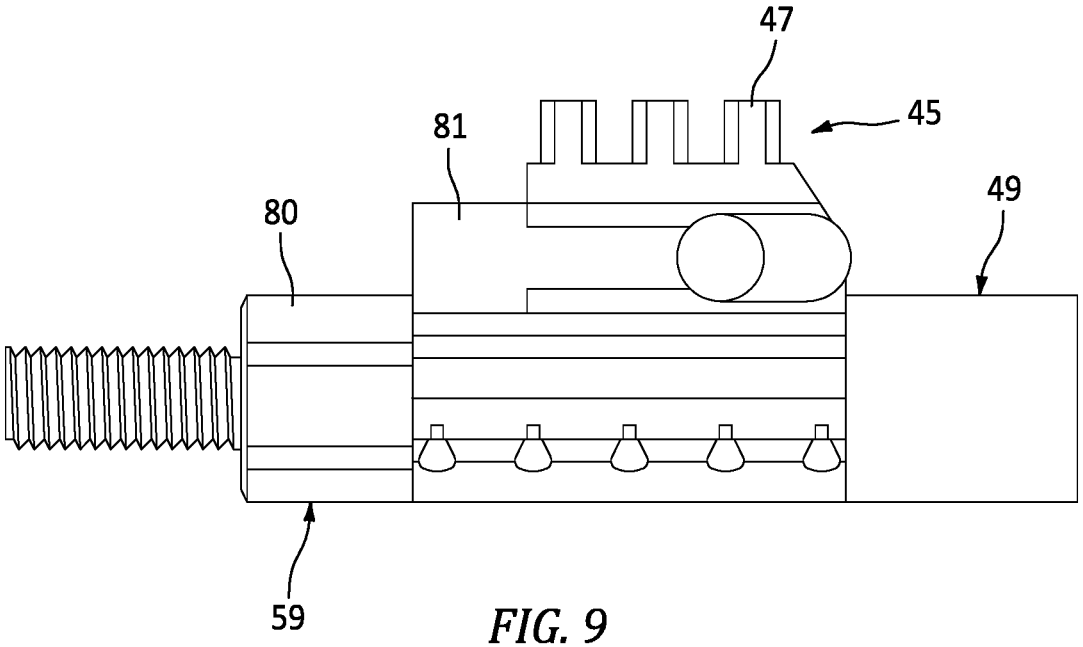
FIG. 9 is an elevation view of the axially drivable assembly in a first condition.
Figure 10:
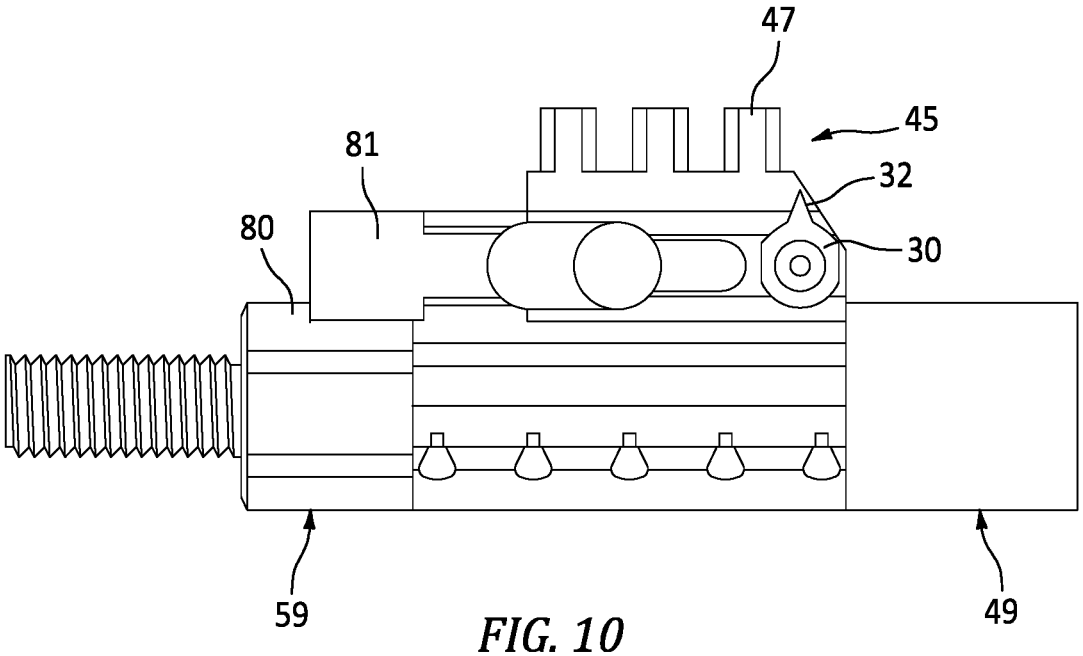
FIG. 10 is an elevation view of the axially drivable assembly in a second condition.

As can be seen in FIG. 9, when the pin 77 and its knob 85 are in a forward position the locking member 81 is located forwardly of the rear hexagonal part 80 of the bushing 59. The bushing 59 is then free to rotate relative to the rest of the axially drivable assembly 49. FIG. 10 shows the situation when the pin 77 and its knob 85 have been moved to a rearward position, thereby urging the fingers 69 and the locking member 81 rearwardiy. The locking member 81 is then slid over the rear hexagonal part 80 and the angled surfaces of the locking member 81 then are in face to face engagement with the corresponding angled surfaces of the rear hexagonal part 80 of the bushing 59. The bushing 59 is then prevented from rotation relative to the rest of the axially drivable assembly 49.

The shaft 42 is in the form of an outer pipe and is arranged parallel to the gearbox output shaft 36. The shaft 42 is supported in the housing 18 for longitudinal reciprocal movement. The housing 18 has at its front end an opening 44 through which the shaft 42 extends (see FIG. 5). When the gearbox output shaft 36 is driven to rotate, the nut 40 and its attached sleeve 41 move longitudinally, causing the axially drivable assembly 49 to follow the longitudinal movement, and hence the shaft 42 is driven longitudinally.

Figure 8:
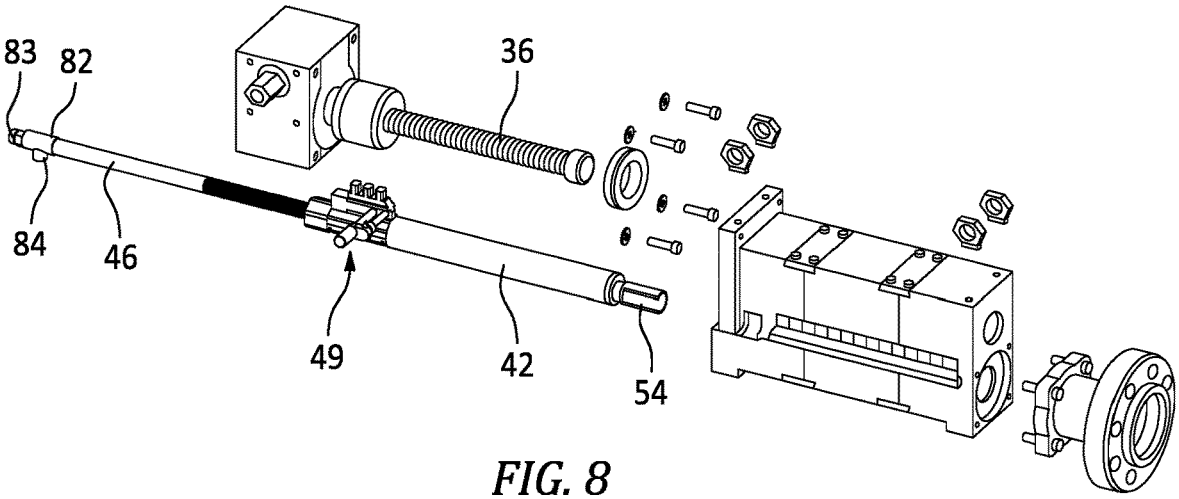
FIG. 8 is an exploded view of certain components of the tool.
Figure 8A:
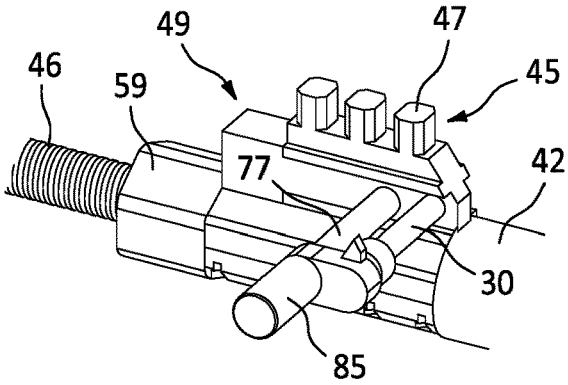
FIG. 8*a* is an enlargement of part of FIG. 8, showing an axially drivable assembly.
Figure 8B:
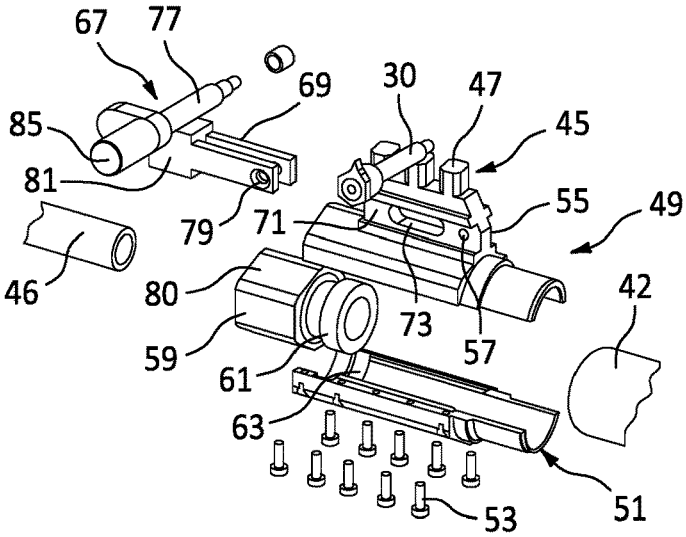
FIG. 8*b* is an exploded view of the axially drivable assembly of FIG. 8*a*.

Referring to FIGS. 8*a* and 8*b*, the tell tail 30 is screwed into the hole 57 in the tower 55 of the axially drivable assembly 49 so that it moves with the tower 55 and the shaft 42. Thus, longitudinal movement of the tower 52 is shown by the pointer 32 of the tell pipe 30 with respect to the ruler 29.

Figure 5A:
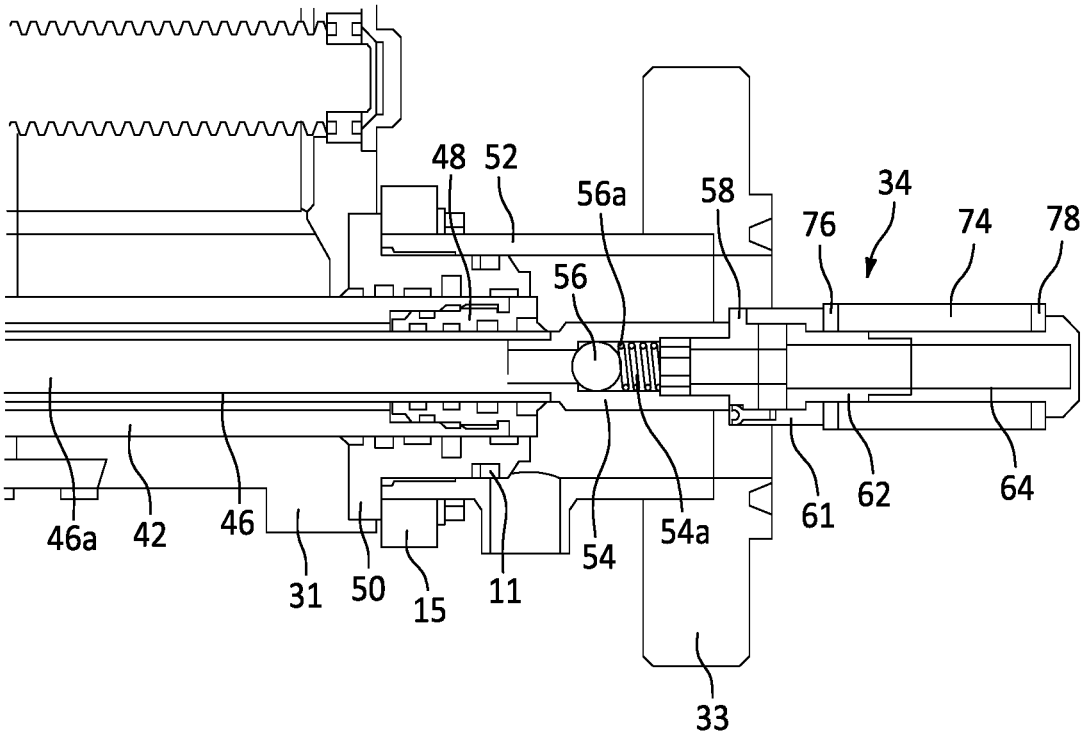
FIG. 5*a* is a longitudinal sectional view through the front part of the tool.
Figure 6:
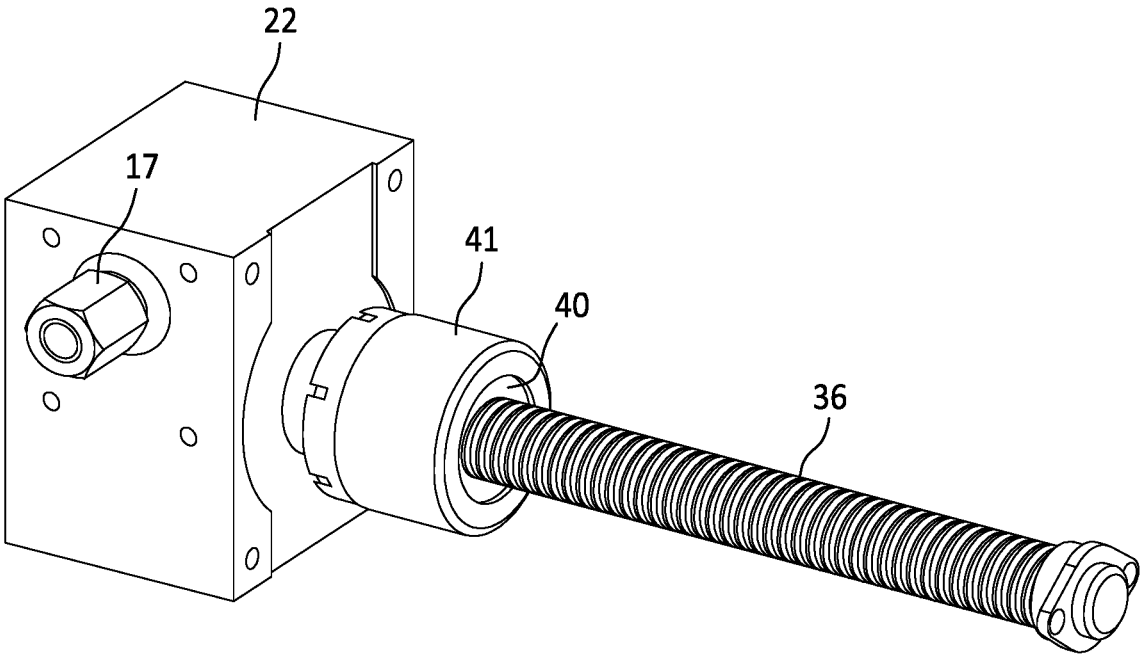
FIG. 6 is a perspective view of a rear part of the tool.
Figure 7:
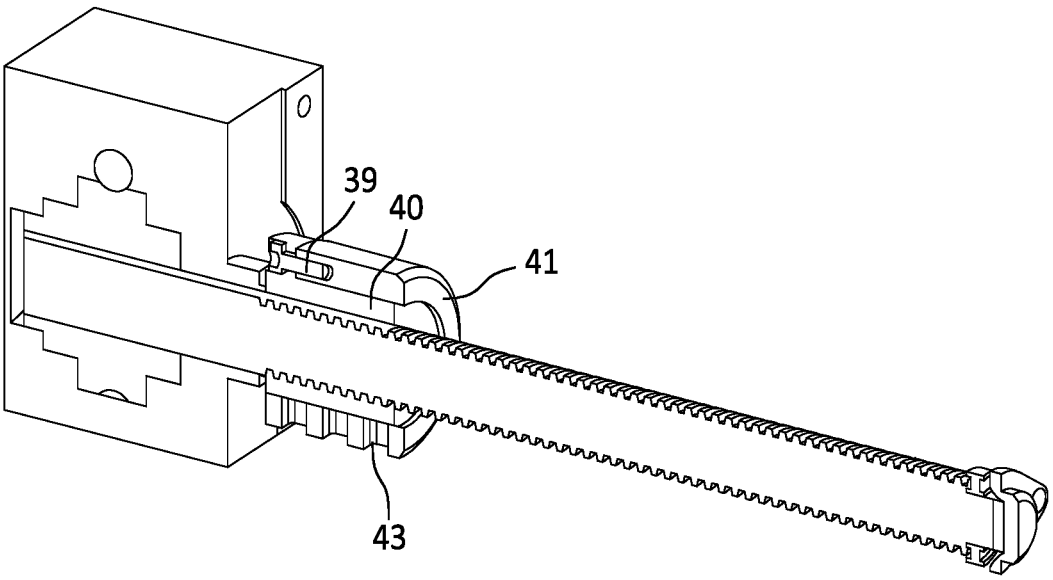
FIG. 7 is a cut away view of the rear part shown in FIG. 6.

FIGS. 5 and 5A show details of the manner in which the opening 44 at the front wall 31 is sealed, as well as the manner of attachment of the ferrule assembly 34 to the shaft 42. A packing 50 is secured in a forward facing recess in the front wall 31 by a plate 15 which is bolted to the front wall and retains a rear flange of the packing 50. A generally tubular casing 52 has is welded at its rear end to the packing forwardly of its flange. An annular seal 11 seals between the outside cylindrical surface of the packing 50 and the inside of the casing 52, thereby sealing the inside of the casing 52 relative to the outside environment. The casing 52 extends forwardly to the flange 33 and these two components are welded together. The packing 50 is provided with a longitudinal bore which seals against the outside of the shaft 42 by a plurality of annular seals which allow relative axial movement of the shaft and the packing.

A fluid transmission conduit comprising an inner pipe 46 extends axially within the outer pipe of the shaft 42. At its front end the inner pipe 46 is sealed to the shaft 42 (i.e. the outer pipe) by a pipe-to-pipe packing 48. The packing 48 is screwed into the front end of the shaft 42 and an annular seal seals between the outside cylindrical surface of the packing 48 and the inside of the shaft 42. A plurality of annular seals on the inside surface of the packing 48 are provided for sealing against the outside surface of the inner pipe 46 to allow relative movement between the packing 48 and the inner pipe, such as rotational and axial movement.

Thus the packing 50 seals between the casing 52 and the shaft 42 (outer pipe), and the packing 48 seals between the shaft 42 and the inner pipe 46, whereby the interior of the housing 18 is sealed with respect to the pressure forwardly of the packings contained within the casing 52 of the front adapter assembly 24. Therefore the interior of the housing is isolated from well pressure, as is the annulus between the shaft 42 (outer pipe) and the inner pipe 46 as they extend through the housing.

The casing has a lateral outlet opening 13 which can be used for fluid to be discharged from the interior of the casing when needed. For example if fluid, such as cleaning or flushing fluid, is delivered via the inner pipe 46, fluid can be allowed to escape via the outlet opening 13.

When it is desired to bolt the flange 33 of the front adapter assembly 24 to the radially outer flange 9 of the valve 8, it is necessary to align the bolt holes 26 with corresponding bolt holes in the flange 9. The bolts attaching the plate 15 to the front wall 31 of the housing 18 may be loosened to allow the housing 18 to be rotated relative to the casing 52 and packing 50, so that the tool can be oriented taking account of the space available radially outwardly of the well. The bolts may then be tightened.

When the flanges 33 and 9 are bolted together, the seal (not shown) in the annular recess 35 of the front face of the flange 23 of the front adapter assembly 24 engages with the radially outer flange 9 of the valve. Thus, the region within the casing 52 of the front adapter assembly is sealed from the outside and may be subjected to the pressure within the wellhead annulus 12. The packings 50 and 48 seal the rear end of the casing 52 so that the shaft 42 may reciprocate longitudinally through the packing 50 whilst a pressure tight seal is maintained.

At its front end the inner pipe 46 receives therein and is welded to a reduced diameter rear portion of a pipe connector 54. In this embodiment, the pipe connector 54 may form part of a head portion of the tool and can serve as an adapter to mount other parts of the head portion in the form of attachments. As can be seen in FIG. 8, the pipe connector 54 has an external surface which is hexagonal, enabling it to transmit torque.

At its front end the pipe connector 54 is secured to a flanged connection piece 58, thereby providing a connection to the ferrule assembly 34. Thus in this case the ferrule assembly 34 is an attachment mounted by the pipe connector 54. A check valve 56 having a spring 56*a* is provided in the pipe connector 54, allowing fluid to be supplied into the ferrule assembly.

The inner pipe 46 comprises a first fluid passageway 46*a* for delivering fluid to the pipe connector 54. The pipe connector 54 comprises a second fluid passageway 54*a* for receiving fluid from the first fluid passageway 46*a* and for delivering it to the ferrule assembly 34.

The flanged connection piece 58 is removable from the pipe connector 54. The flanged connection piece 58 provides support for a first ferrule bushing 61, which is screwed to the flanged connection piece 58 and projects forwardly therefrom. At its front end the first ferrule bushing has a radially inwardly projecting flange. A second ferrule bushing is received in the front end of the first ferrule bushing 61 and has at its rear end a radially outwardly projecting flange. The first and second ferrule bushings are capable of relative axial movement. A sealing tube 74 is mounted on the front ferrule bushing 62 and extends axially between a rear washer 76 and a front washer 78. The sealing tube 74 is also mounted on a nozzle tubing 64 which is connected to and extends forwardly of the front ferrule bushing 62. At its front end the nozzle tubing 64 has a laterally directed outlet opening 65 for delivery of fluid.

The rear washer 76 has an internal diameter slightly larger than the external diameter of the second ferrule bushing 62, and the front washer 78 has an internal diameter slightly larger than the external diameter of the nozzle tubing 64. Thus, both the rear washer 76 and the front washer 78 are slidable in the longitudinal direction. Therefore, if the rear washer 76 is pushed forwardly towards the front washer 78 the sealing tube 74 is axially compressed between the washers, causing the sealing tube to expand radially. This enables a seal to be formed with a lateral access passage, for example the passageway 10 through the valve 8 or the side opening 6 in the outer wall of the wellhead.

The check valve 56 provided inside the check valve tubing 54 allows forward fluid flow towards the outlet opening 65 but prevents rearward flow.

As seen in FIG. 5, the inner pipe 46 extends rearwardly from the pipe-to-pipe packing 48 inside the shaft 42 (or outer pipe). For part of its length, where it extends through the bushing 59 of the axially drivable assembly 49, it is provided with an external thread (see FIGS. 8 and 8*a*). When the shaft 42 is in the retracted position shown in FIGS. 1-5 the inner pipe 46 extends rearwardly of the housing 18. At its rear end it is provided with an inner pipe nut 83, allowing for a connection to a rotational drive to be provided, so as to rotate the inner pipe. At its rear end the pipe 46 is also provided with a swivel connection 82 of a known kind, having an inlet 84 for the introduction of fluid, such as a sealant or cleaning fluid.

Longitudinal, or forward and rearward, movement of the ferrule 34 (or other front attachment to be described later) is primarily provided by the drive input to the gearbox 22, which rotates the shaft 36, causing longitudinal movement of the nut 40, in turn causing longitudinal movement of the tower 55 attached to the shaft 42. However, the tool also permits additional longitudinal movement to be imparted to the attachment at its front end by operation of the inner pipe 46. If the operator places the pin 77 shown in FIGS. 8*a* and 8*b* in a forward position, as shown in FIG. 9, then the bushing 59 is capable of rotational movement relative to the axially drivable assembly 49. In these circumstances, if the inner pipe 46 is rotatably driven then the bushing 59 rotates therewith and there is no relative axial movement between the inner pipe 46 and the shaft (or outer pipe) 42. If however, the pin 77 is moved by an operator to the rear position shown in FIG. 10, then the locking member 81 engages with the rear hexagonal part 80 of the bushing 59 and, by locking it to the tower 49 and the shaft 42, prevents the bushing 59 from rotating. In these circumstances, if a rotational drive is applied to the inner pipe nut 83 of the inner pipe 46 the engagement of the external thread on the pipe with the internal thread of the bushing 59 results in axial movement of the inner pipe 46.

In operation, driving of the shaft 36 may be used to provide the main axial movement of the attachment at the front of the tool. Additional forward or rearward axial movement may be provided by locking the bushing 59 and rotationally driving the inner pipe. This additional longitudinal movement may in particular be useful if it is desired to provide small forward and rearward movements simultaneously with rotational movement, for example when using a brush as the attachment, as described below.

Figure 11:
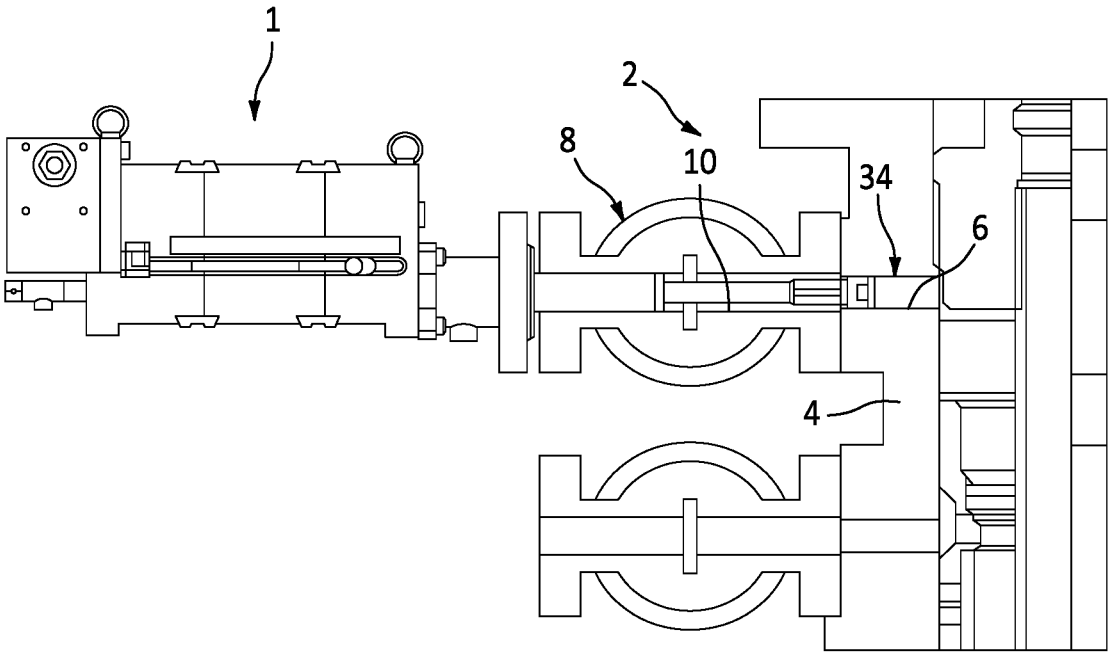
FIGS. 11 and 12 show the tool at two stages of operation in relation to the well.
Figure 12:
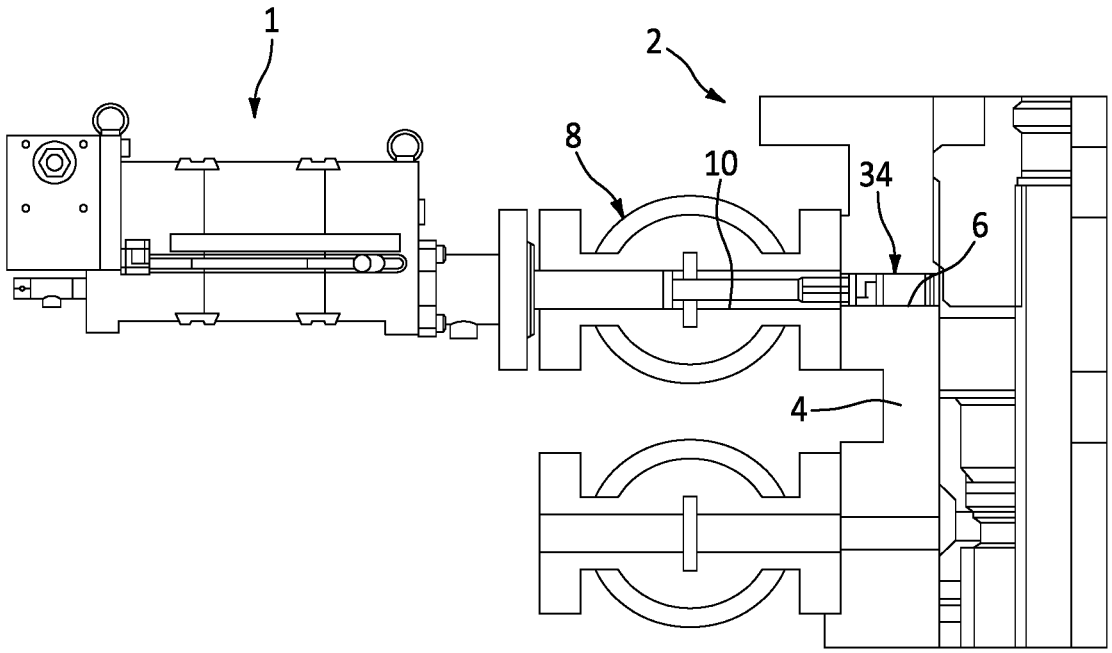
Figure 13:
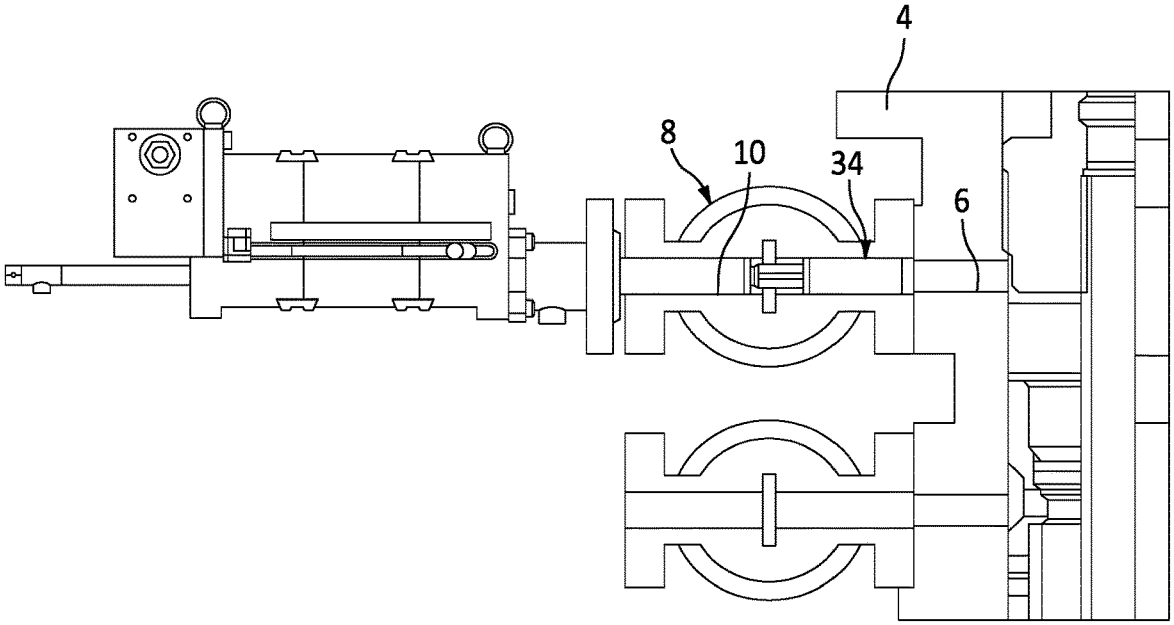
FIG. 13 shows a view similar to FIGS. 11 and 12 but with another example of use.

Examples of the use of the tool when the front attachment is a ferrule 34 are shown in FIGS. 11, 12 and 13. Initially, the tool is sealingly bolted to the wellhead by bolting the front flange 33 to the radially outer flange 9 of the valve 9. At this stage the ferrule 34 is shown in the retracted position seen in FIGS. 2 and 3. Rotational drive is imparted to the input shaft 17 of the gearbox 22 and, as discussed previously, this causes forward advancement of the shaft 42, with the ferrule 34 as the attachment at its front end. FIG. 11 shows the situation when the ferrule 34 has advanced through the passageway 10 in the valve 8 and through the side opening 6 in the wellhead wall 4. At this point the front surface of the nozzle tubing 64 abuts against the radially outer wall of the tubing hanger 16 and prevents further advancement of the nozzle tubing. The shaft 42 is driven further forwardly a small amount, to cause the first ferrule bushing 61 to slide relative to the second ferrule bushing 62, which is prevented from further forward movement by being secured to the nozzle tubing 64 which itself has been arrested, so that the first ferrule bushing 61 pushes on the slidable rear washer 76. The rear washer 76 moves towards the front washer 78 and in doing so axially compresses the sealing tube 74 and causes it to expand radially. The sealing tube forms a seal with the inside of the side opening 6.

Fluid may then be delivered via the swivel connection 82 at the rear of the inner pipe 46. The pressure of the fluid opens the check valve 56 and the fluid passes along the ferrule 34 and into the space inside the wellhead via front outlets 65. The fluid may be a sealant, formulated either to float or to sink in the well fluids, in order to repair a leak above or below the side opening. Because the sealing tube is sealed against the inner surface of the side opening 6, right up to the radially innermost part thereof, the side opening is protected from exposure to the fluid, e.g. sealant. In addition, the passageway 10 through the valve 8 is also so protected.

After the remedial operation carried out by the fluid delivery has been completed, the shaft 42 is retracted by driving the shaft 36 in a reverse direction. Initial retraction of the shaft 42 releases the sealing tube 74 from the axial compression applied between rear washer 76 and front washer 78 so that it disengages from the side opening 6. After that, the ferrule may be fully withdrawn and the valve 8 closed again.

FIG. 13 shows another example of the use of the tool when the front attachment is a ferrule 34. In this case the ferrule has a diameter slightly wider than that of the side opening 6 in the wellhead wall 4, so that the front face of the nozzle tubing 64 abuts against an annulus of the wellhead outer wall 4 around the radially outer part of the side opening 6. With further advancement of the shaft 42 the sealing tube 74 expands radially outwardly in the same manner as described in relation to the example of FIGS. 11 and 12, so as to form a seal with the passageway 10. Fluid may then be delivered into the side opening 6, with the passageway 10 of the valve 8 protected from exposure to that fluid. This may be appropriate if it is acceptable to block the side opening 6 with sealant. Alternatively, after an appropriate amount of sealant has been delivered, a precise dose of grease may be delivered to push the sealant radially inwardly into the wellhead and out of the side opening 6, thereby avoiding the side opening from being blocked by cured sealant.

Figure 14:
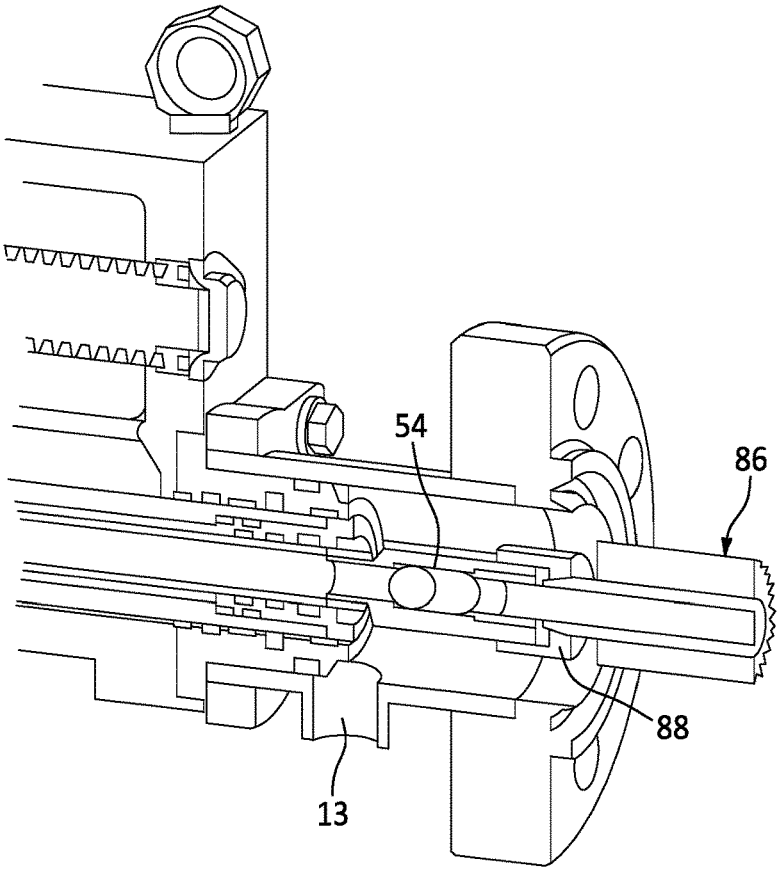
FIG. 14 is a cut away view of a front part of the tool having a cleaning brush.
Figure 15:
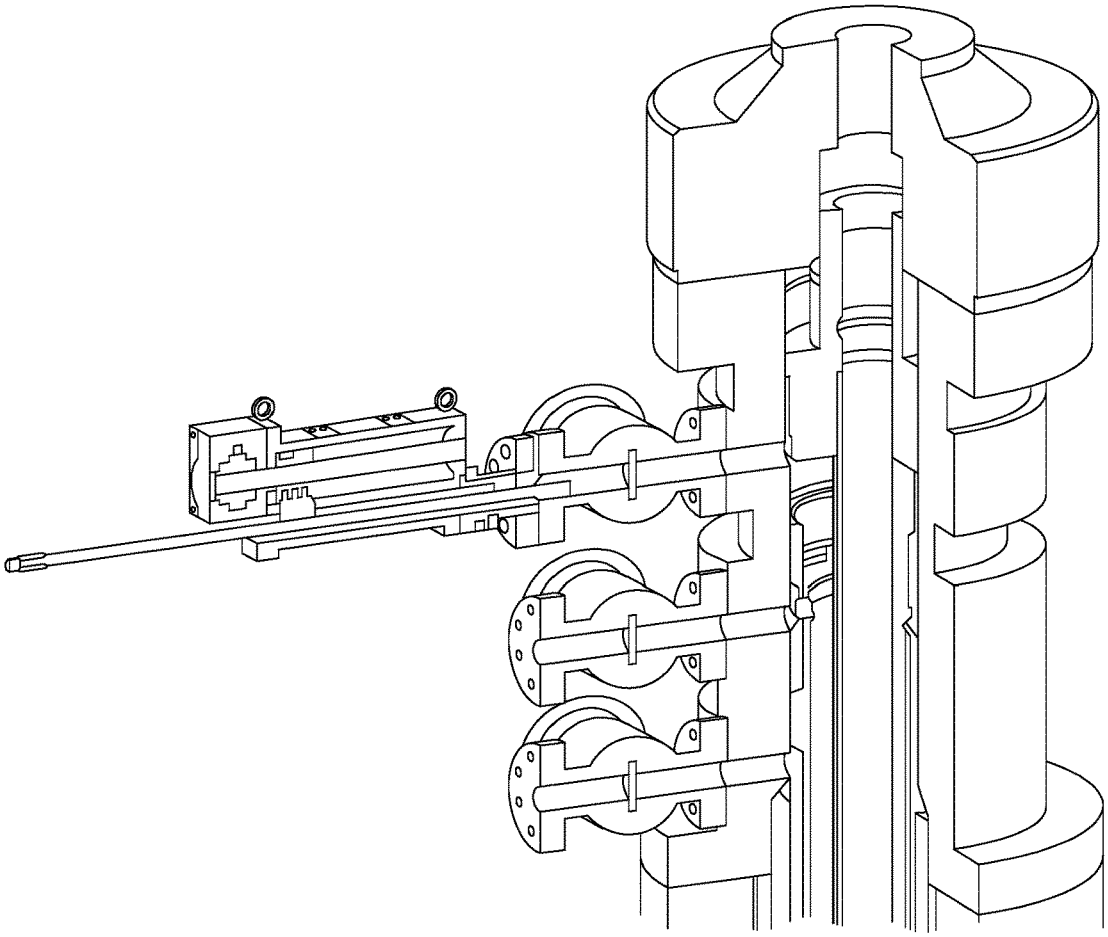
FIG. 15 is a perspective view of the tool with the cleaning brush being used with a well head, shown partially cut away.
Figure 16:
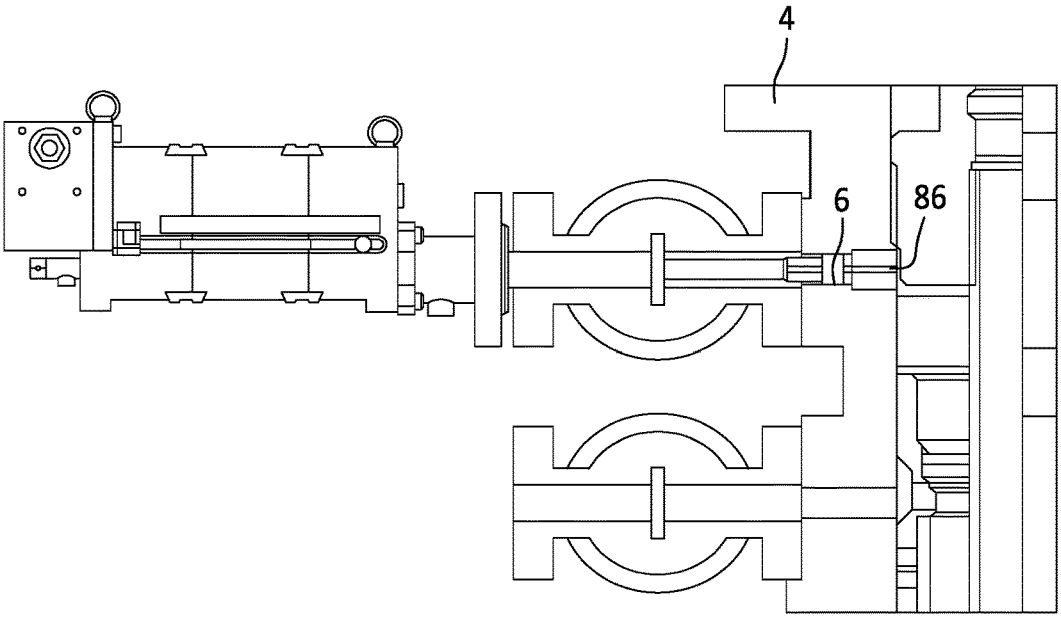
FIG. 16 shows the tool when the cleaning brush has been advanced forwardly.

FIG. 14 shows an alternative embodiment in which the ferrule 34 is replaced with a brush 86. In this case the flanged connection piece 58 has been removed from the pipe connector 54 and a brush adapter piece 88 is fixed to the pipe connector 54. FIG. 15 shows the tool with the brush 86 as the front attachment in the retracted position and FIG. 16 shows the tool when the brush has been advanced to its forwardly stroked position. The movement of the brush from the retracted to the forwardly stroked position is accomplished in the same way as described for the ferrule 34. Once the brush 86 is in the forward position it resides inside the side opening 6 of the wellhead wall 4. Its purpose is to clean the inside of the side opening, for example if the side opening has an internal thread this may have accumulated debris. In operation, the brush 86 is rotated by applying a rotational drive to the nut 83 at the rear of the inner pipe 46. If a small amount of forward and rearward movement of the brush during rotation is desired, then the bushing 59 is prevented from rotation by operation of the switch device 67, so that rotation of the inner pipe 46 results in axial movement of the inner pipe relative to the shaft 42 (or outer pipe), and hence relative to the housing 18 of the tool the rotational drive may be applied in alternate clockwise and anticlockwise movements so that the brush is moved forwardly and rearwardly whilst remaining in the side opening 6.

If on the other hand no forward and rearward movement of the brush is required, then the switch device 67 may be operated to unlock the bushing 59 from the rest of the axially drivable assembly 49. The bushing 59 may then rotate along with the inner pipe 46 when it is rotationally driven, so that there is no axial movement of the inner pipe 46 relative to the shaft 42 (or outer pipe).

It will be noted that cleaning fluid may be discharged from the brush at the same time as it is rotated, enhancing the cleaning effect. Suitable openings (not shown) are provided in the hub of the brush 86, directed radially outwardly and/or in the axial end of the hub.

FIGS. 17-20 show an example of use of the tool when the front attachment is a plug 90 which is used for sealingly plugging the wellhead side opening 6. The plug 90 is of a known type and has an external thread. The tool 1 may be used to unscrew the plug 90 from the side opening 6 or to screw the plug into the side opening. In this case, a plug adapter piece 92 (see FIG. 20) is mounted on the pipe connector 54 in a non-rotatable manner. The plug adapter piece 92 has a socket head 94 of a known type, allowing it to latch onto a hexagonal rear part 95 of the plug 90 in a simple push fit connection. Once latched on, rotation of the plug adapter piece 92 causes rotation of the plug 90. By pulling rearwardly the plug adapter piece 92 with sufficient force, it may be unlatched again. Thus, by rotating the inner pipe 46, and transmitting this rotation through to the plug adapter piece 92, the plug 90 may be screwed into or unscrewed from the side opening 6.

During screwing or unscrewing, the plug 90 moves axially, and axial movement of the plug adapter piece 92 relative to the pipe connector 54 can be accommodated by a connection between these two components, which permits relative axial movement but not relative rotational movement. The hexagonal plug and socket arrangement permits relative axial movement, and there is also provided means (not shown) for axially retaining adapter piece 92 on the pipe connector 54.

An alternative to the hexagonal plug and socket which may be provided is a splined connection, also with axial retaining means.

Figure 20:
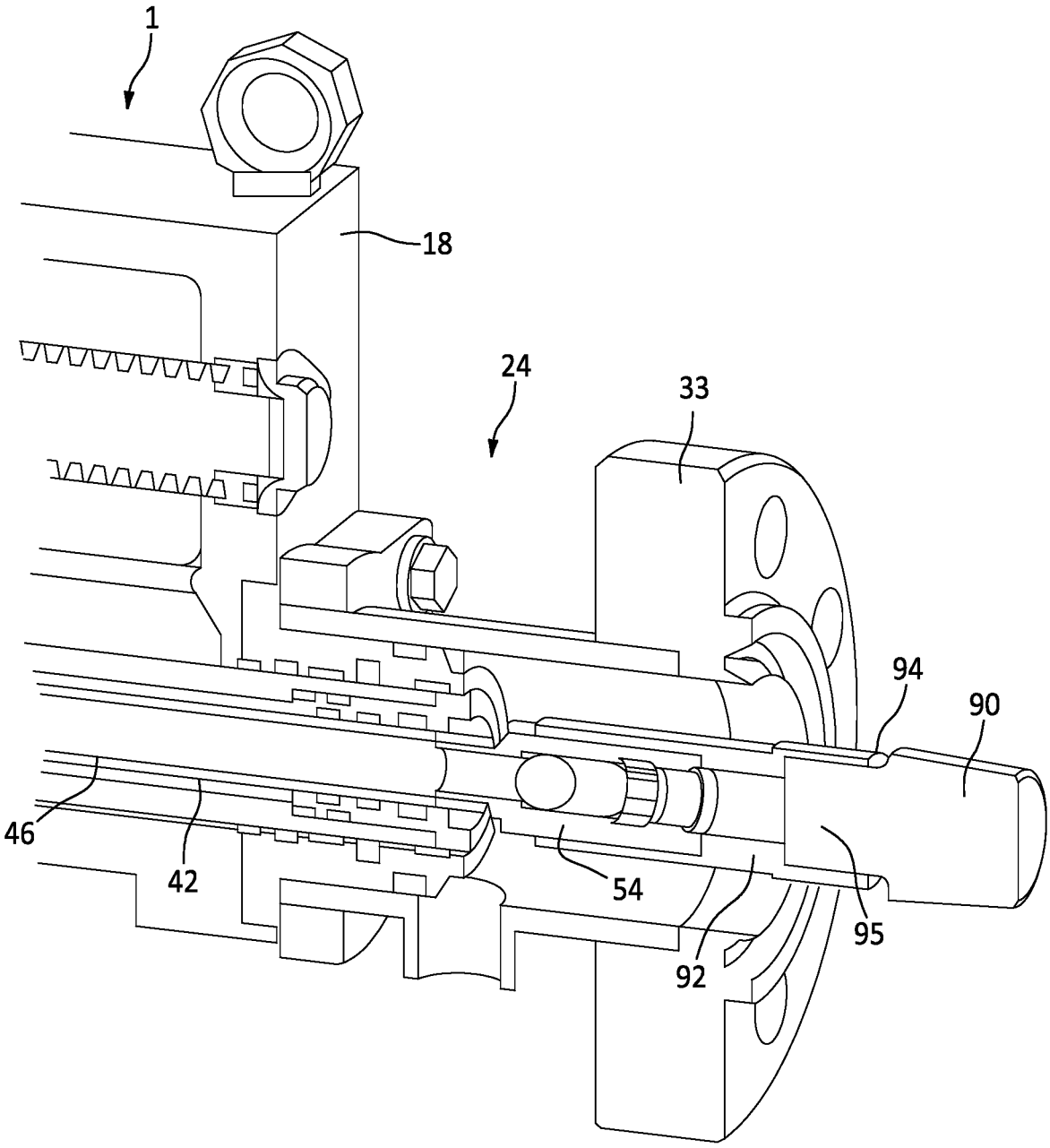
FIG. 20 is a cut away view showing the front part of the tool when holding a plug.

It will be noted that in the embodiment of FIG. 20, although the tool still has a fluid transmission conduit, this is not used in the operation of screwing or unscrewing the plug 90.

Figure 17:
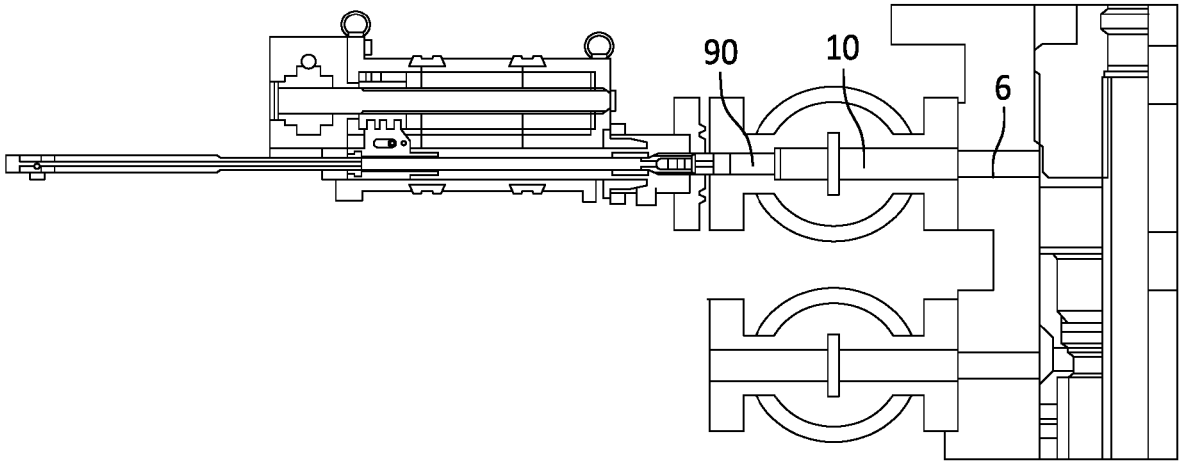
FIGS. 17 to 19 are side elevation views of the tool having a socket member and being used to install a plug in a side opening of a well wall.
Figure 18:
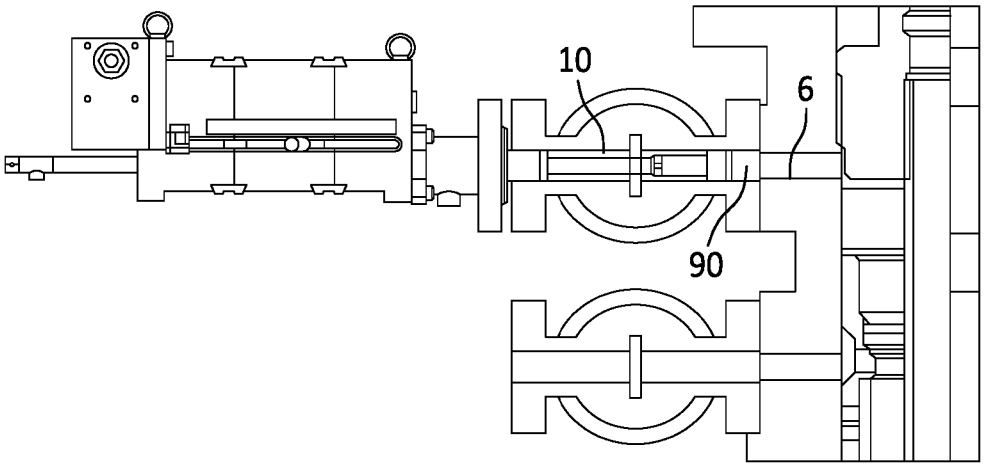
Figure 19:
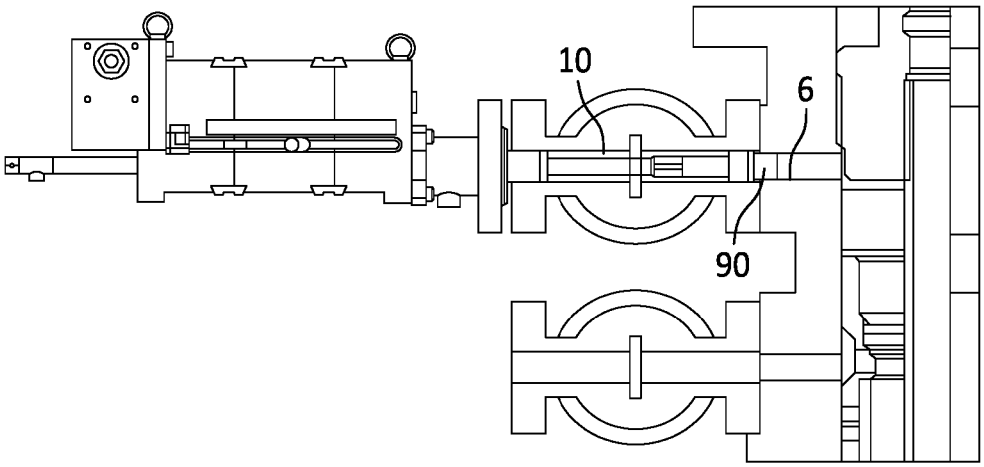

FIGS. 17-19 show different stages of operation during the installation of a plug 90 into a side opening 6. FIG. 17 shows the plug 90 in the retracted position. FIG. 18 shows the plug 90 when its front end has reached the radially outer part of the side opening, just before screwing in has commenced. FIG. 19 shows the plug 90 screwed into the side opening 6.

Figure 21:
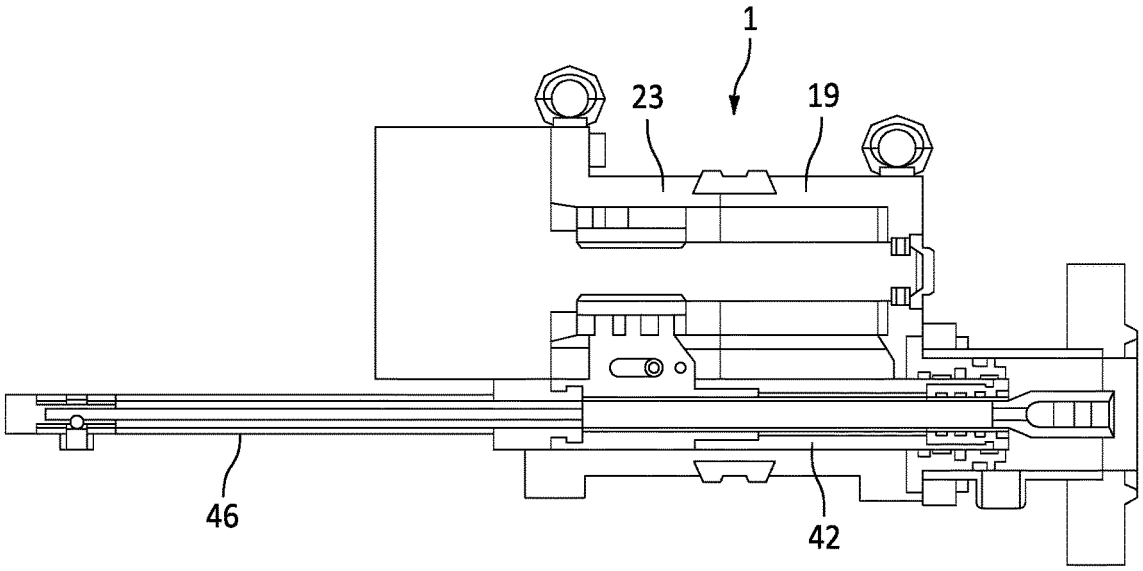
FIG. 21 is a longitudinal sectional view of a tool with front and rear housing portions, and its shaft in a rearward position.
Figure 22:
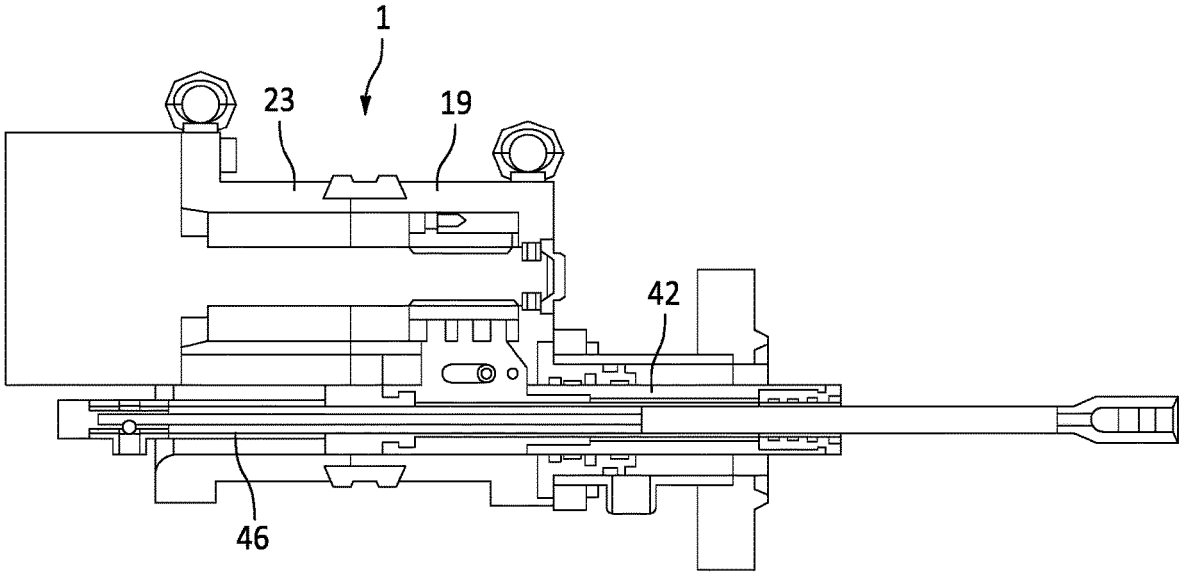
FIG. 22 is a view similar to FIG. 21 with the shaft in a forward position.

FIGS. 21 and 22 show an embodiment of the tool 1 in which the intermediate housing portion 21 is omitted. The tool 1 therefore has a front housing portion 19 and a rear housing portion 23.

Figure 23:
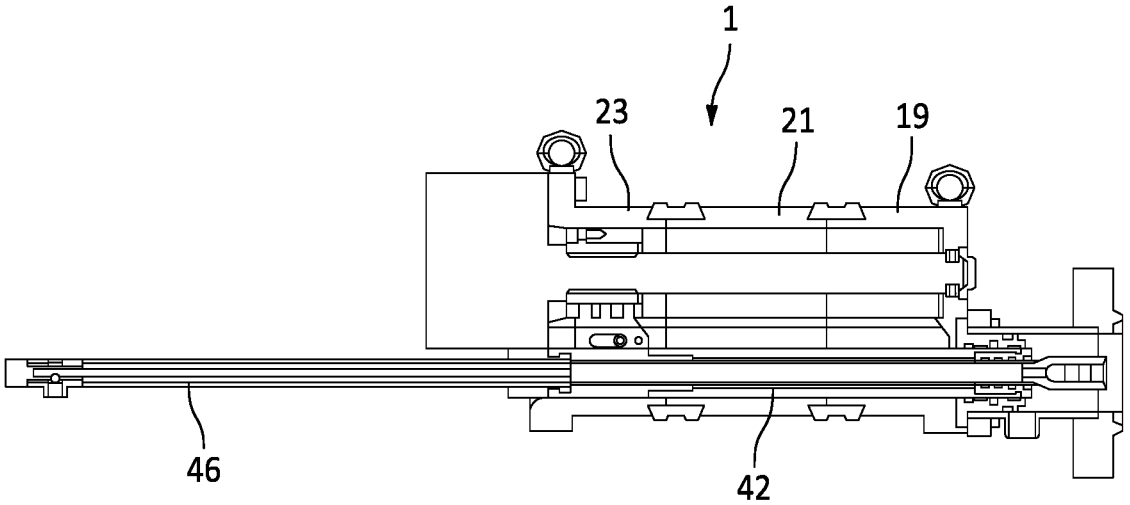
FIG. 23 is a longitudinal sectional view of a tool with front, intermediate and rear housing portions, and its shaft in a rearward position.
Figure 24:
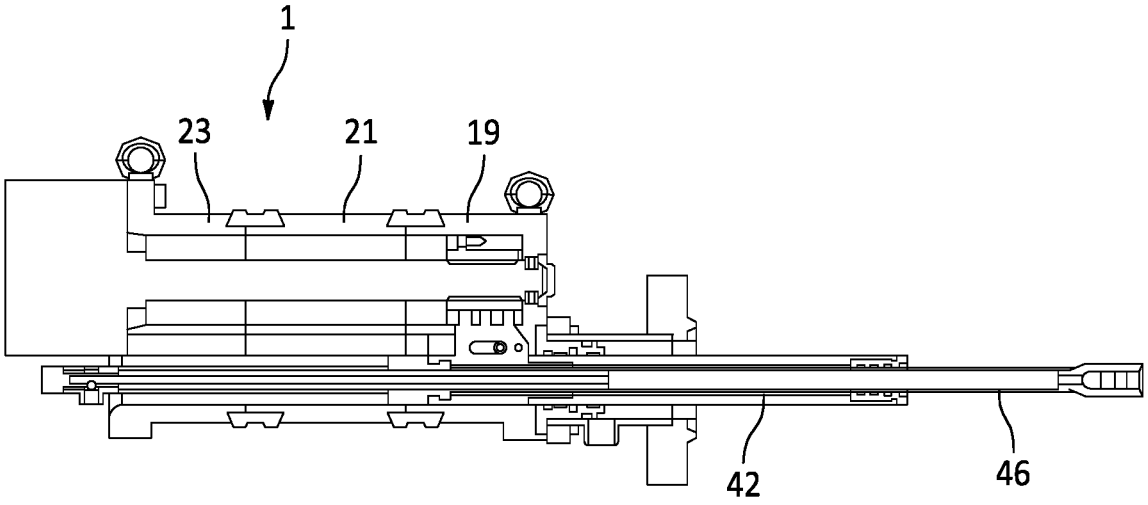
FIG. 24 is a view similar to FIG. 23 with the shaft in a forward position.

The tool 1 shown in FIGS. 23 and 24 corresponds to that already described, having a front housing portion 19, an intermediate housing portion 21 and a rear housing portion 23.

Figure 25:
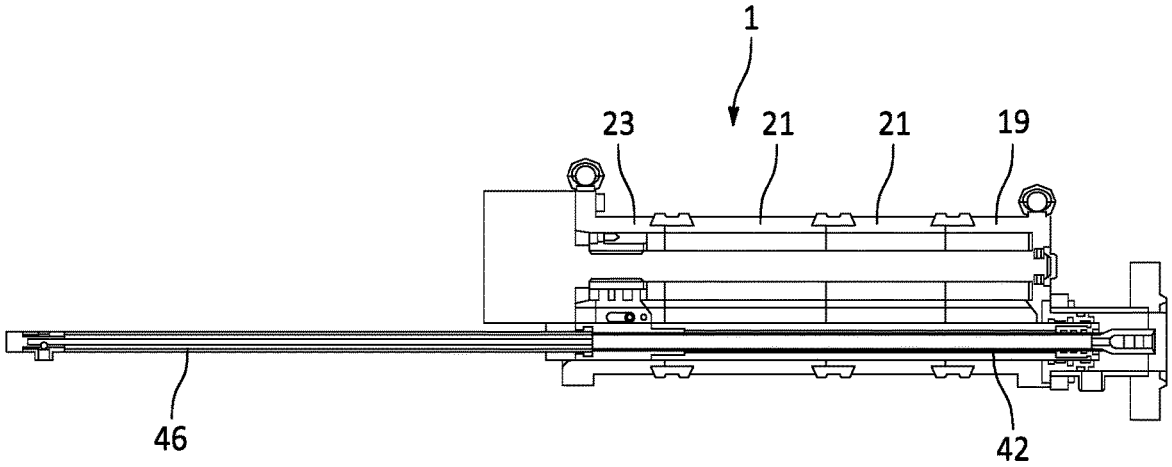
FIG. 25 is a longitudinal sectional view of a tool with front, first intermediate, second intermediate and rear housing portions, and its shaft in a rearward position.
Figure 26:
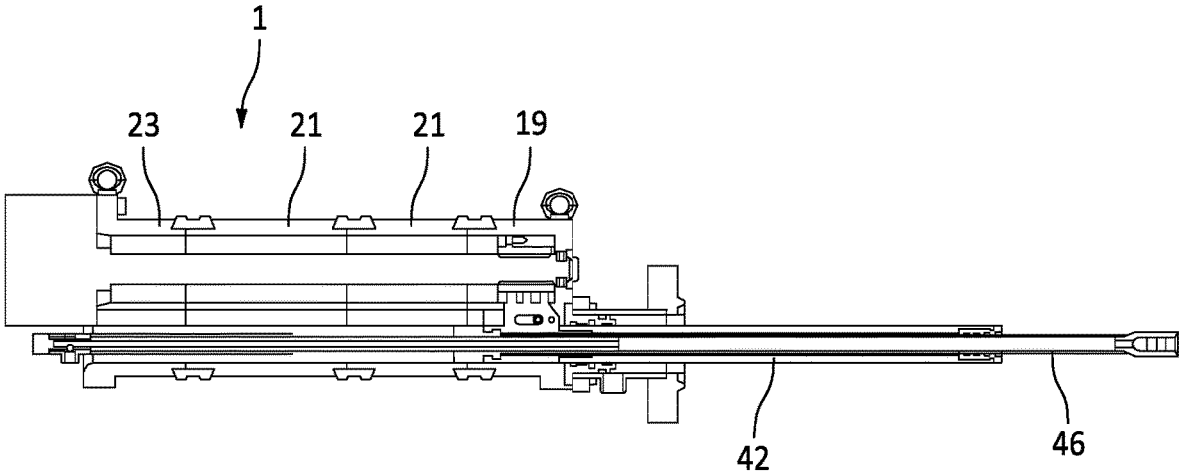
FIG. 26 is a view similar to FIG. 25 with the shaft in a rear position.
Figure 27:
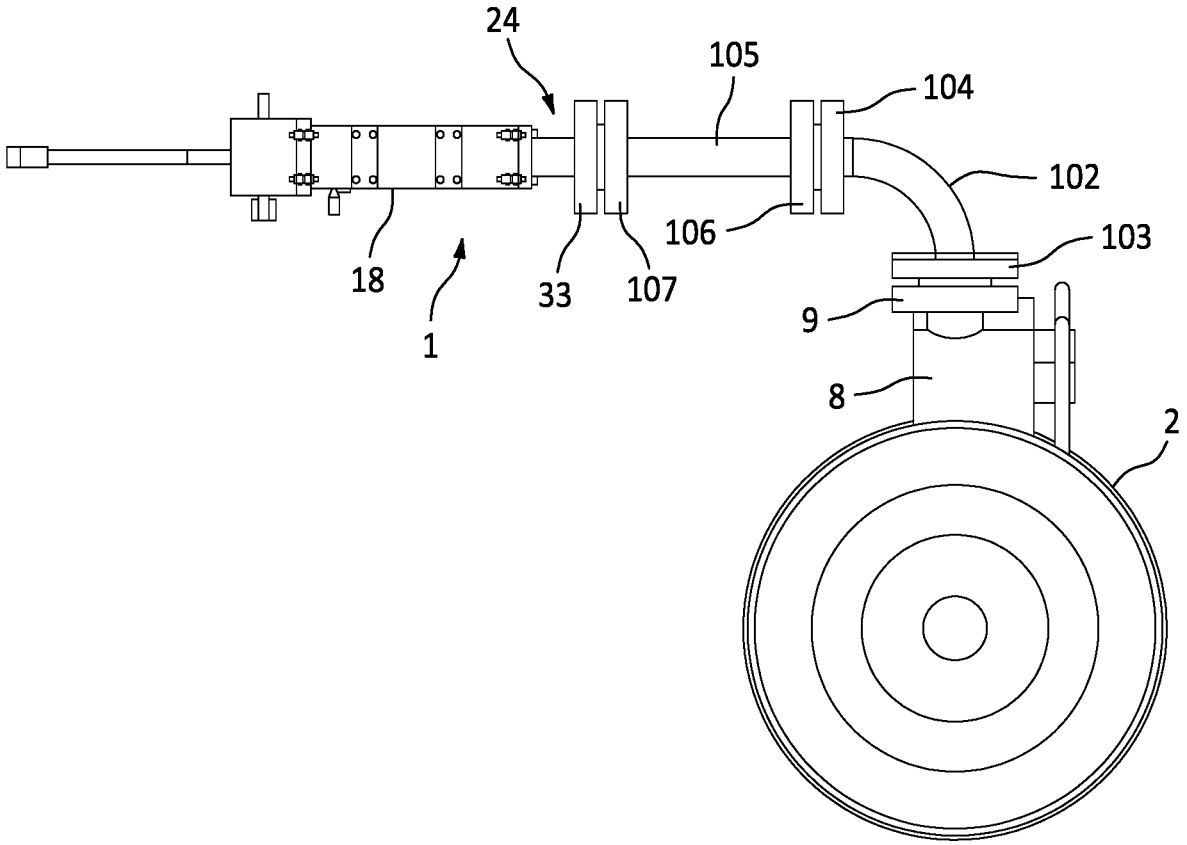
FIG. 27 is a plan view of a tool of the invention connected to a wellhead.

The tool 1 shown in FIGS. 25 and 26 has a front housing portion 19, a rear housing portion 23 and two intermediate housing portions 21.

In each of the three above-mentioned embodiments, it will be noted that there is no front attachment, whereby the front end of the shaft 42 is formed by the pipe connector 54. Each of the illustrated tools may be used with each type of front attachment, namely a ferrule 34, a brush 86 or a plug adapter piece 92.

The tool shown in FIGS. 23 and 24 is of an intermediate length. The tool shown in FIGS. 21 and 22 is shorter, by omission of the intermediate housing portion 21. The tool shown in FIGS. 25 and 26 is longer, by virtue of the addition of an extra intermediate housing portion 21. Therefore, a toolkit is provided allowing a user to select different lengths of tool. A shorter tool may be necessary if there is a limited amount of space available, in particular radially outwardly of the well. The shorter tool will have a shorter stroke length, i.e. the length between fully retracted and fully advanced and so if radial space is limited and the shorter stroke length is acceptable, then this tool can be used. The tool of intermediate length, shown in FIGS. 23 and 24 can be used where there is more space radially outwardly of the well, and provides an increased stroke length. The tool of FIGS. 25 and 26 may be used if there is even more radial space outwardly of the well and provides an increased stroke length.

It will be noted that the different length tools 1 are also provided with different lengths of shaft 42 (or outer pipe) and inner pipe 46. The above-described toolkit provides a modular system. Starting with the shorter tool 1 shown in FIGS. 21 and 22, if it is desired to increase the stroke length, then the front housing portion 19 and the rear housing portion 23 are separated and the shaft 42 and inner pipe 46 are removed. The intermediate housing portion 21 is placed between the front and rear housing portions and the appropriate intermediate length shaft 42 and inner pipe 46 are installed.

If a longer tool length is required then an additional intermediate housing portion 21 is inserted and the longer shaft 42 and inner pipe 46 are inserted. Of course, it is also possible to start with a longer length tool and to reduce it in length by reversing the procedures described above.

FIGS. 27-31 show an alternative arrangement for installing a plug 90 in a well head side opening 6. The plug is of the same known type shown in FIG. 20 and, as in the example of FIG. 20, may be screwed by the tool 1 into the side opening or unscrewed from the side opening. The arrangement for holding the plug is the same as that described in relation to FIG. 20. However, in this embodiment an elongate transmission member 101 is connected to the plug adapter piece 92 at the front end of the inner pipe 46 to be rotationally drivable by the inner pipe. in an alternative embodiment, the inner pipe 46 could be replaced by a solid rod, giving it greater strength and hence being able to transmit a greater amount of torque (this also applies to the embodiment of FIGS. 17-20 or any embodiment where fluid transmission is not required).

The elongate transmission member 101 is guided in a curved guide passage 102, so as to be deviated from the forward driving direction of the tool 1 through a 90° bend into a radial direction with respect to the well head 2, i.e. in alignment with the direction of the side opening 6. A forward flange 103 is provided at the front end of the curved guide passage 102 and a rear flange 104 is provided at the rear of the curved guide passage. The forward flange 103 is bolted to the radially outer flange 9 of the valve 8 of the well head 6.

Extending between the front of the front adapter assembly 24 of the tool 1 and the curved guide passage 102 a straight guide passage 105 is provided. This also has a flange at each end, namely a forward flange 106 and a rear flange 107. The forward flange 106 is bolted to the rear flange 104 of the curved guide passage 102. The rear flange 107 of the straight guide passage 105 is bolted to the flange 33 of the front adapter assembly 24 of the tool 1.

By the use of the curved guide passage 102, the amount of space in a radial direction with respect to the well (which is the same direction as the axis of the side opening 6 in the well head wall 4) required by the tool can be smaller than that which would be required if the tool 1 were oriented with its drive axis, i.e. the axis of the shaft 42, in a radial direction with respect to the well. This can be useful in situations where there is only a limited amount of radial space but the tool needs to provide sufficient stroke to provide the required amount of forward advancement of the plug 90.

By the use of the straight guide passage 105, the front end of the inner pipe 46 can follow a straight path along that passage during the forward stroke of the tool. The elongate transmission member is flexible and is guided round the curved guide passage 102. The plug 90 follows a straight path along the valve passage 10 and the side opening 6.

Figure 31:
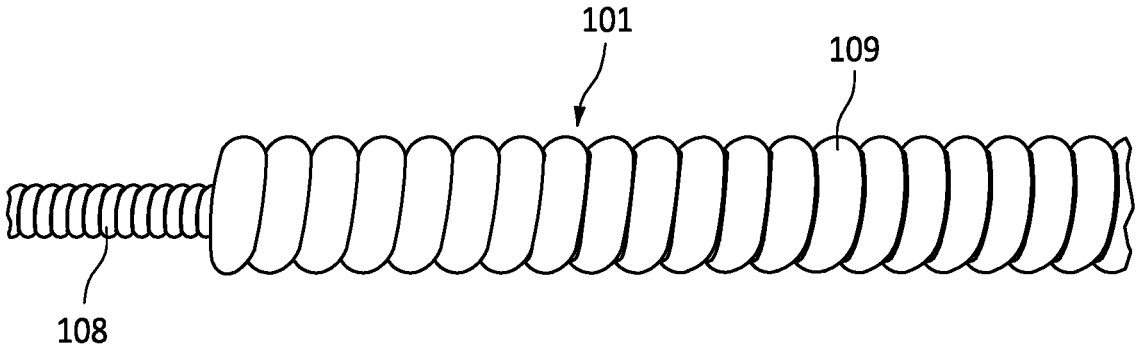
FIG. 31 is an elevation view of an elongate transmission member.

The elongate transmission member 101 is capable of transmitting torque about its central axis to enable the plug 90 to be turned and thereby screwed or unscrewed. It is capable of providing the necessary axial forward or reverse drive to advance or retract the plug. it is capable of bending along the curved guide passage 102. In order to be able to do this, the elongate transmission member is made of a cable known as a sewer cable or a drain snake. An example of such a known cable type is shown in FIG. 31. This has an inner core 108 and an outer cable portion 109. Suitable cables are available from www.draincables.com.

The inner core 108 has a slightly smaller external diameter than the outer cable portion 109, so that it is sufficiently flexible to pass through the curved guide passage 102 as the nut 90 is being advanced or withdrawn. When it is desired to turn the nut (as previously described in relation to the embodiment of FIGS. 17-20) and torque builds up, the outer cable portion 109 twists down to grip the inner core 108 and so a high amount of torque may be transmitted.

Figure 28:
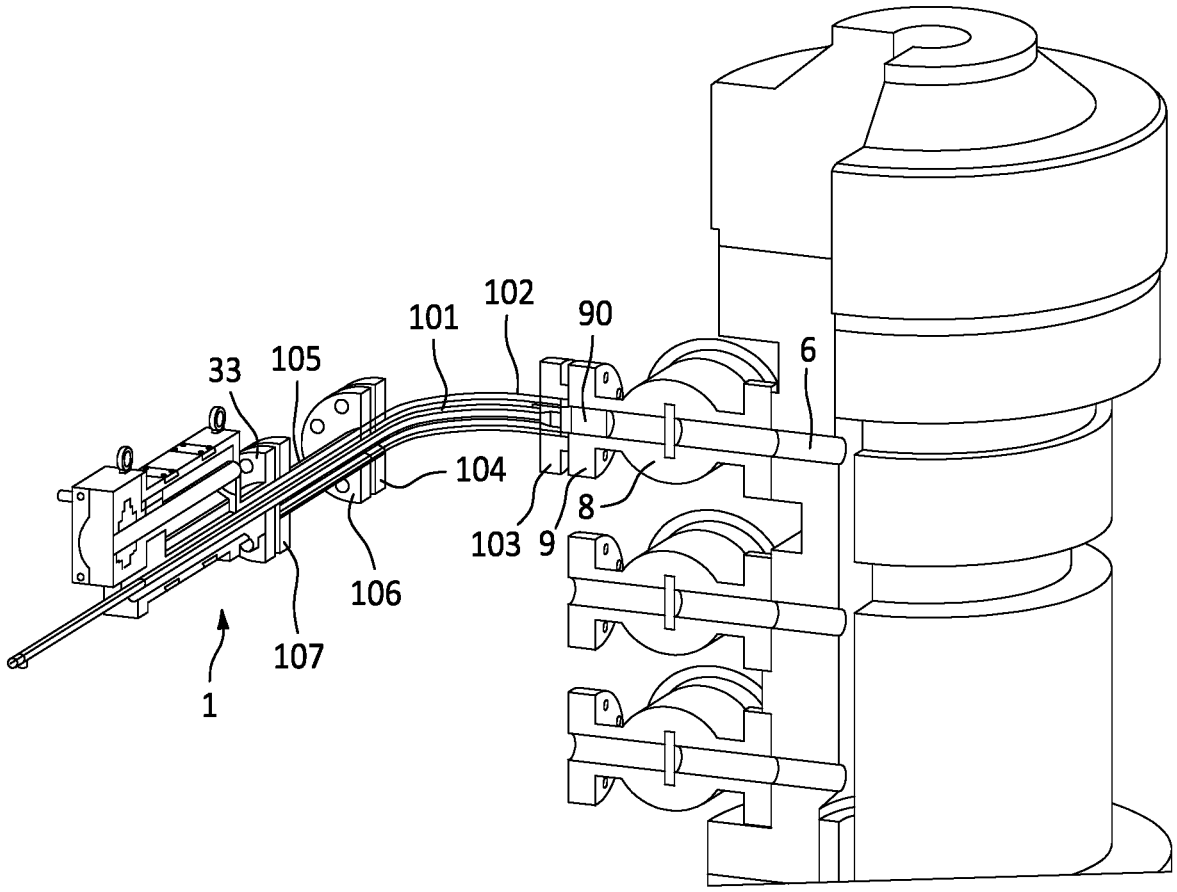
FIGS. 28 to 30 are cut away perspective views of the apparatus of FIG. 27 at various stages of operation.
Figure 29:
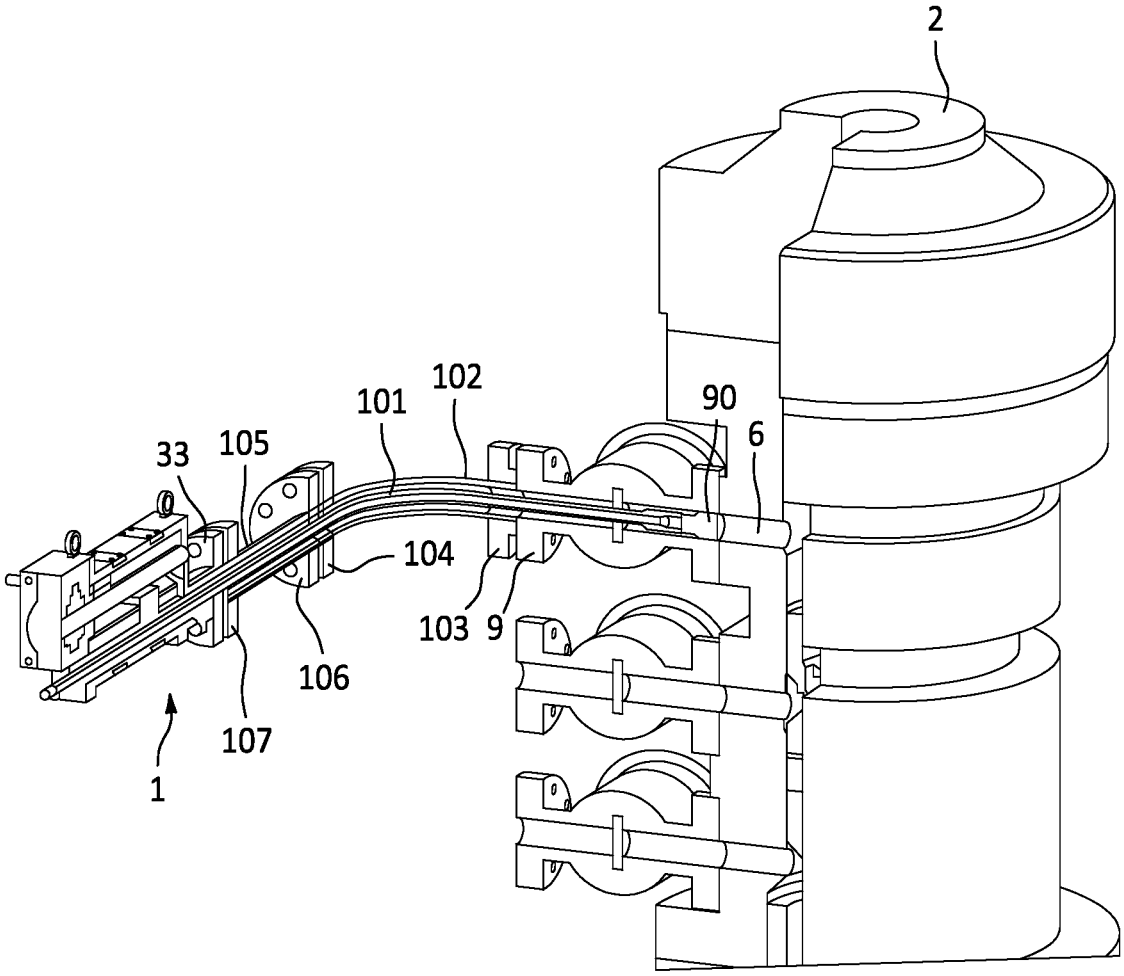
Figure 30:
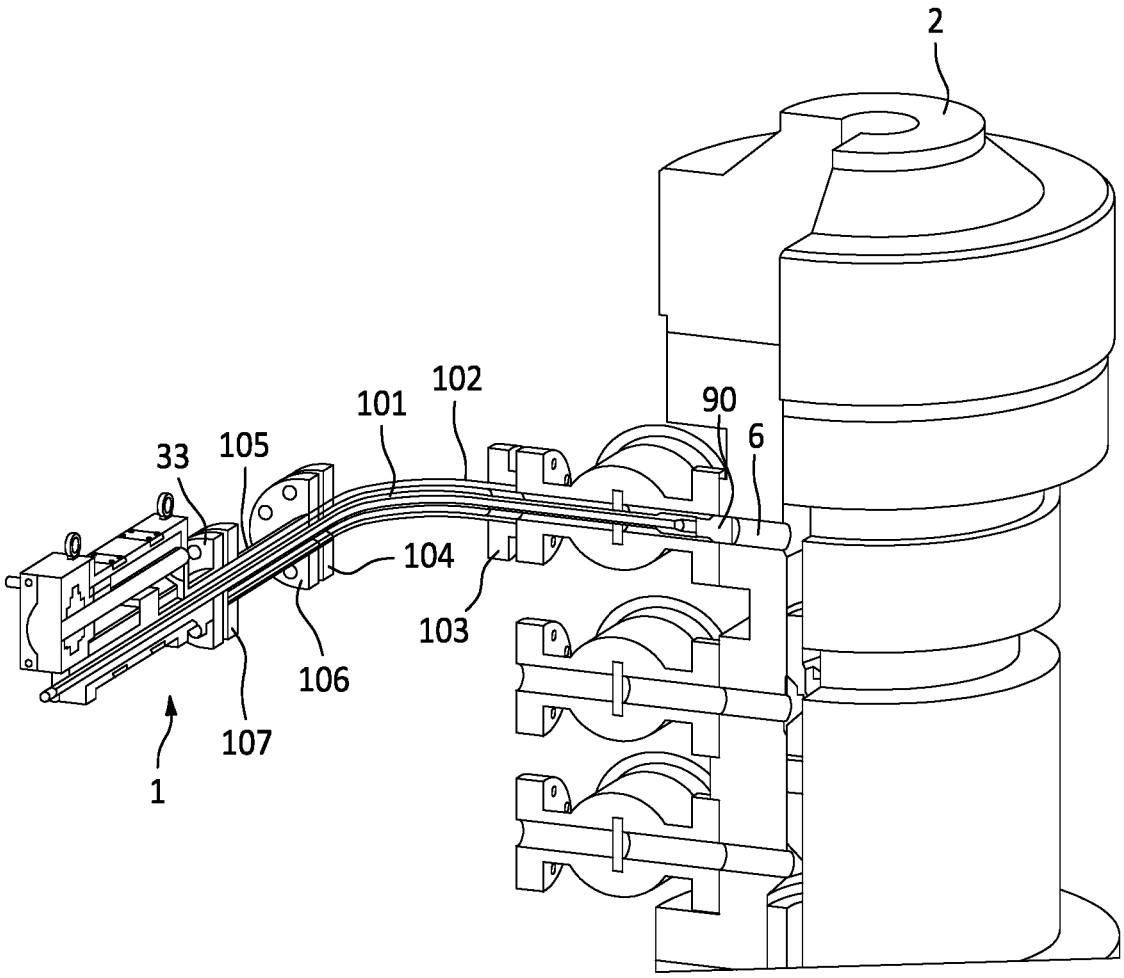

FIG. 28 shows the system using the curved guide passage 102 and elongate transmission member 101 when the plug has just entered the valve 8. FIG. 29 shows the situation when the plug 90 has been advanced to the radially inner end of the valve 8. The tool 1 is then operated to rotate the elongate transmission member 101, in the manner previously described for the embodiment of FIGS. 17-20. In this case, the initial rotation tightens the outer cable portion 109 onto the inner core 108. After that, further rotation causes the rotation of the plug 90, in order to fix it in the side opening 6 of the well head wall 4.

The example described above relates to the ability of the tool 1 to provide a torque on an axis different from the forward (and rearward) drive axis of the tool itself. As an alternative to providing a plug 90 on the forward end of the elongate transmission member 101, a brush 86 as shown in FIG. 14 may be placed on the forward end of the elongate transmission member 101. It would then be possible to rotate the brush to provide cleaning as described previously. The brush could be used to clean the threads in the side opening 6 of the well wall 4 before replacing a plug 90.

An alternative form of elongate transmission member 101 may be used, such as polymer/steel composite hose of the type described in WO2012/022987. This would be attached to the front end of the inner pipe and would whilst being flexible enough to pass along the curved guide passage 102 would also be able to transmit torque, although not as much torque as a sewer cable. Such a form of elongate transmission member 101 would also be able to transmit fluid along its length, and so could be used to carry forward a ferrule assembly 34 as shown in FIGS. 5 and 5A, to activate the seal thereof, and to discharge fluid forwardly of the seal.

Thus the system using a curved guide passage, which is useful to meet local space constraints around the well, can be used with various tool devices which are to be moved towards or in the lateral access passage of a well. The plug 90, sealing ferrule assembly 34 and the brush 86 are examples.

It is not necessary for the tool device, such as the plug 90, ferrule assembly 34 or a brush 86, at the front end of the elongate transmission member 101 to be passed along the curved guide passage 102. The system can be rigged up with the tool device positioned at the front end of the curved guide passage 102 before the forward flange 103 is bolted to the radially outer flange 9 of the valve 8.

Figure 32:
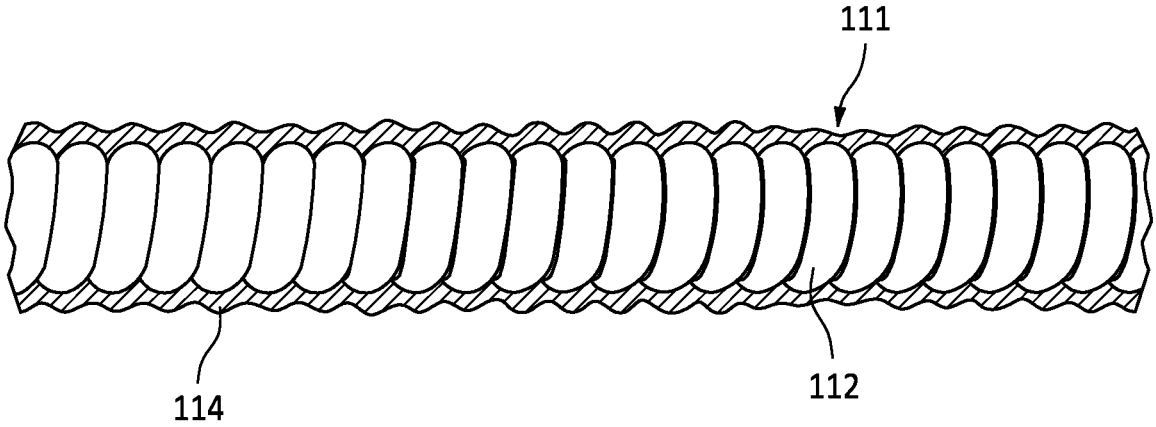
FIG. 32 is an elevation view of another elongate transmission member.
Figure 33:
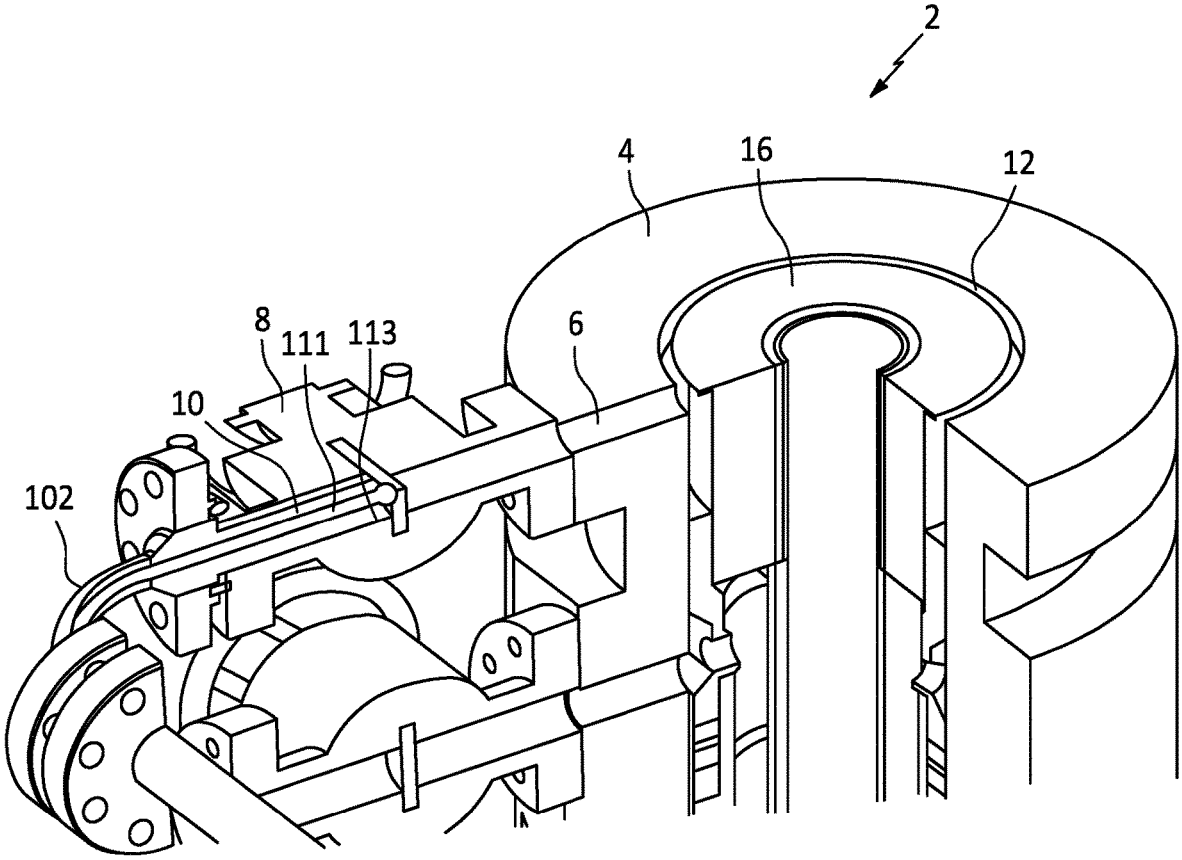
FIG. 33 is a partly cut away perspective view of a curved guide passage is connected to a wellhead.

FIG. 33 shows another arrangement in which a curved guide passage 102 is used to gain lateral access to a well. In this case the elongate transmission member is in the form of a fluid transmitting cable 111. The cable is shown in more detail in FIG. 32. It is made from a known type of "no core" sewer cable or drain snake. The fluid transmitting cable 111 has been adapted from a ⅜ inch "no core" cable available from www.draincables.com. It is made from a helical wire 112 coated with a fluid containing material layer 114. In order to make the cable capable of transmitting fluid, it was subjected to tension and then coated with polyurethane on the outside. The polyurethane was allowed to cure before the tension in the cable was released, thereby forming the layer 114. The cable was pressurised internally with fluid and was found to be fluid tight.

An alternative internal or external coating for the fluid transmitting cable 111 is a polyurethane normally supplied for use in stuffing boxes, for example supplied by Benoil Services Limited as the material from which stuffing box packers are made.

At the front end of the fluid transmitting cable 111 a nozzle 113 having a discharge opening (not shown) is provided. The nozzle 113 has a curved front face so that when the cable 111 is advanced forwardly and the nozzle 113 strikes the tubing hanger 16 it is deviated from the forward direction. The constraints within the annulus 12 are such that with further forward advancement of the cable 111 it cannot move upwardly or downwardly. It therefore will be caused to move circumferentially around the tubing hanger 16. This process will be described in more detail below in relation to FIGS. 35-39.

Figure 34:
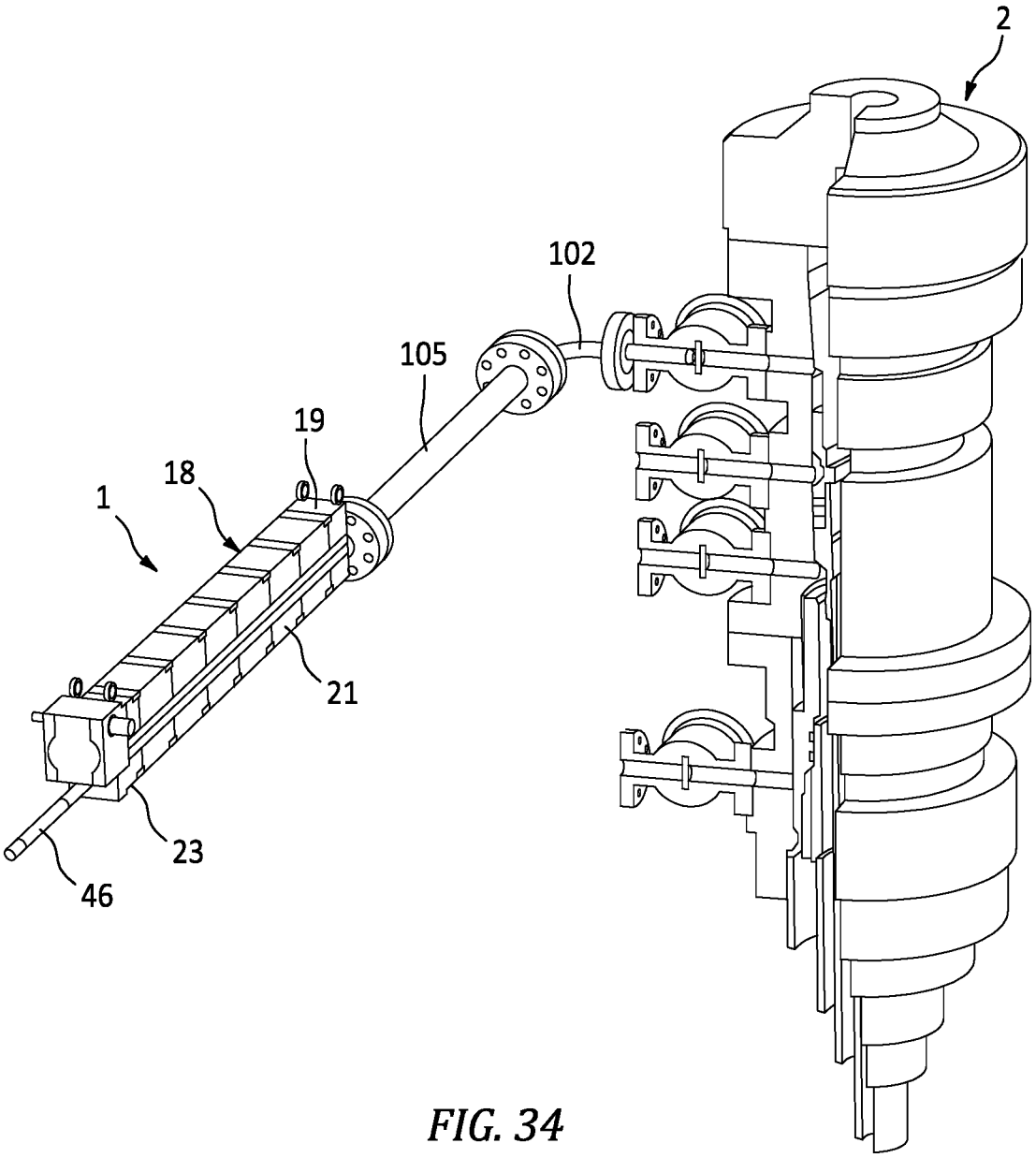
FIG. 34 is a partly cut away perspective view of the apparatus of FIG. 33, showing more details of the tool.

Referring to FIG. 34, the tool 1 has a housing 18 made up of a front housing portion 19, a rear housing portion 23 and six intermediate housing portions 21. The length of the shaft 42 (or outer pipe) and the length of the inner pipe 46 are longer than those shown in the embodiments with fewer housing portions. This allows the tool 1 to have a greater stroke, and hence allow it to provide forward advancement of the fluid transmitting cable 111 over a relatively large stroke length.

Figure 35:
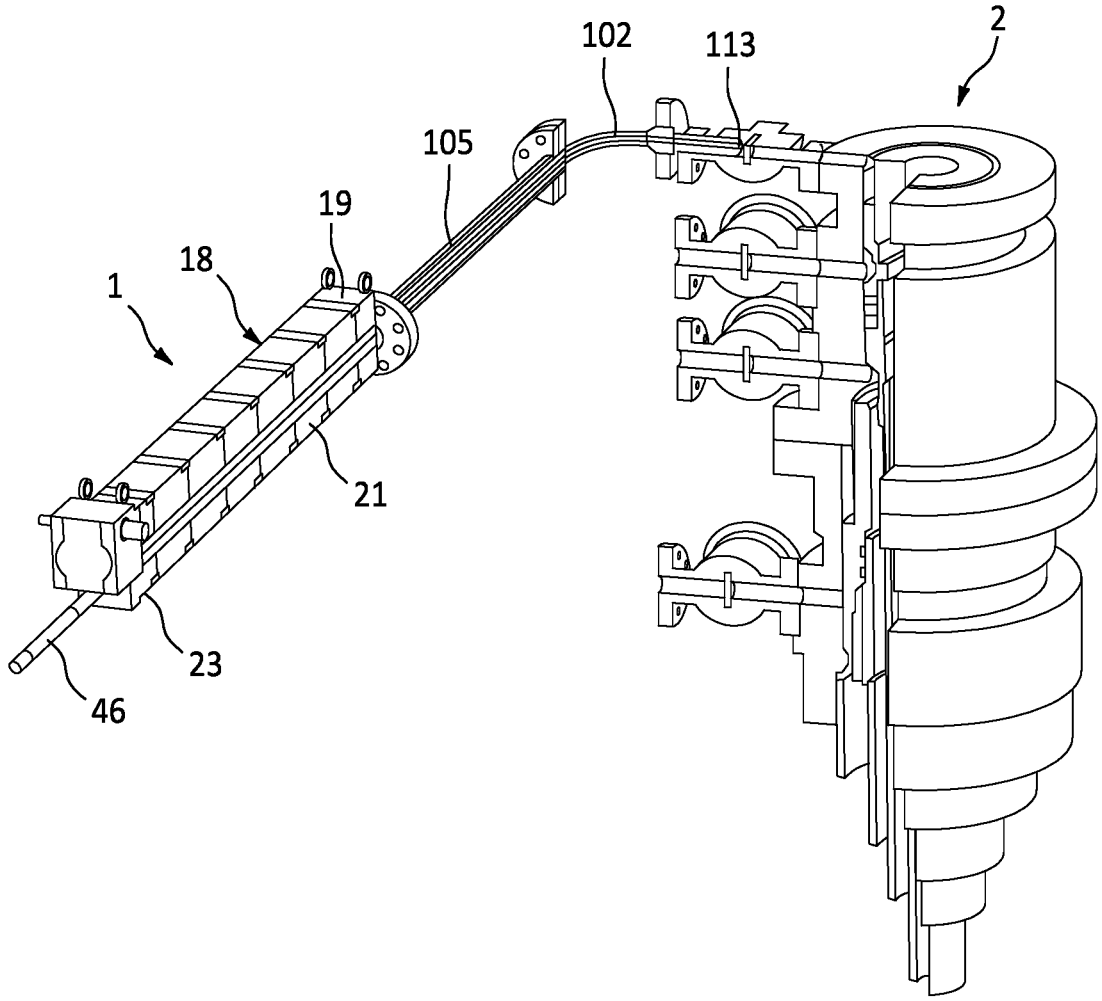
FIG. 35 is a view similar to FIG. 34, showing a straight guide passage and the curved guide passage partly cut away.

FIGS. 34 and 35 show the tool when the shaft 42 is fully retracted. At this stage, the tool has been rigged with the fluid transmitting cable 111 connected to the front end of inner pipe 46 for fluid transmission and projecting from the front end by an amount such that the nozzle 113 at its forward end is just behind the gate of the valve 8. The fluid transmitting cable 111 is connected at its rear end to the pipe connector 54 to allow fluid transmission along the inner pipe 46, through the pipe connector 54 and into the fluid transmitting cable 111.

Figure 36:
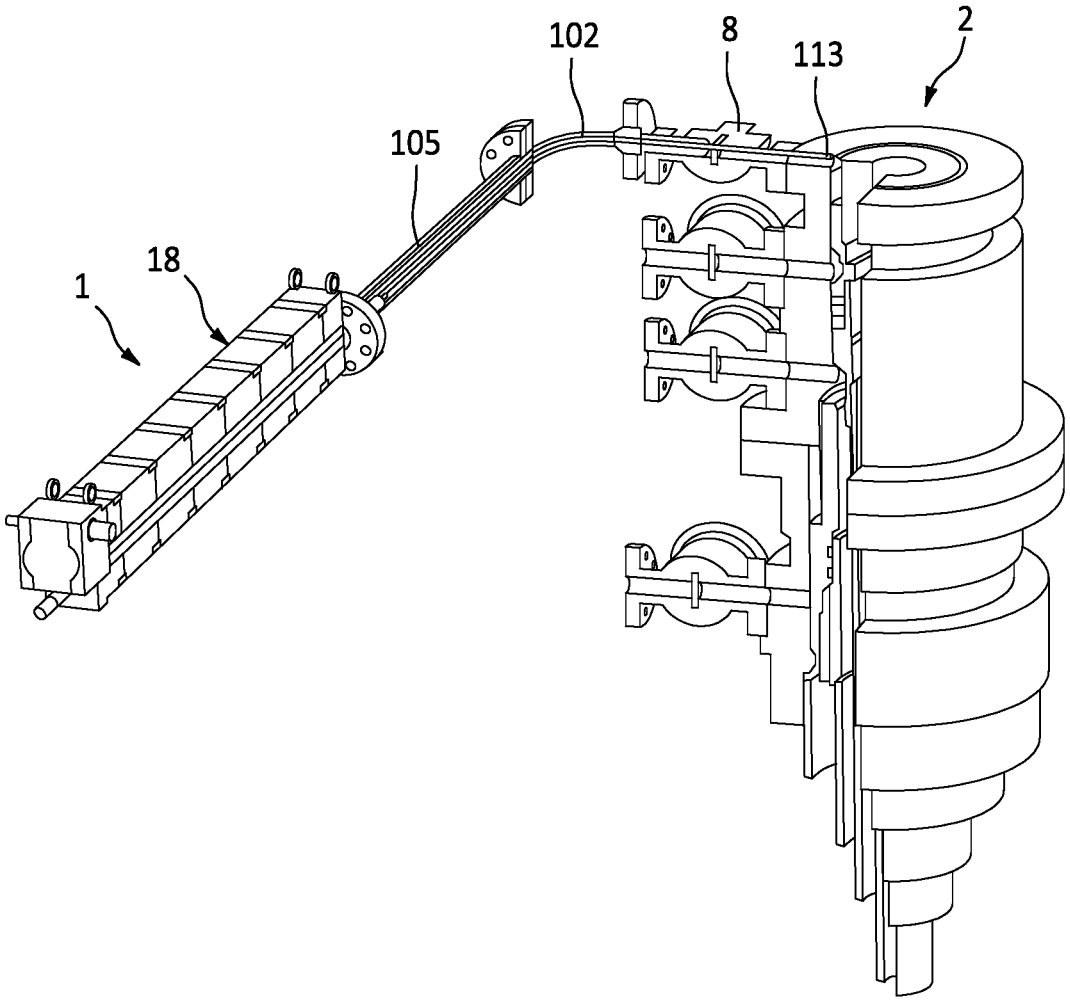
FIGS. 36 to 39 are views similar to FIG. 35 showing the apparatus at various stages of operation.
Figure 37:
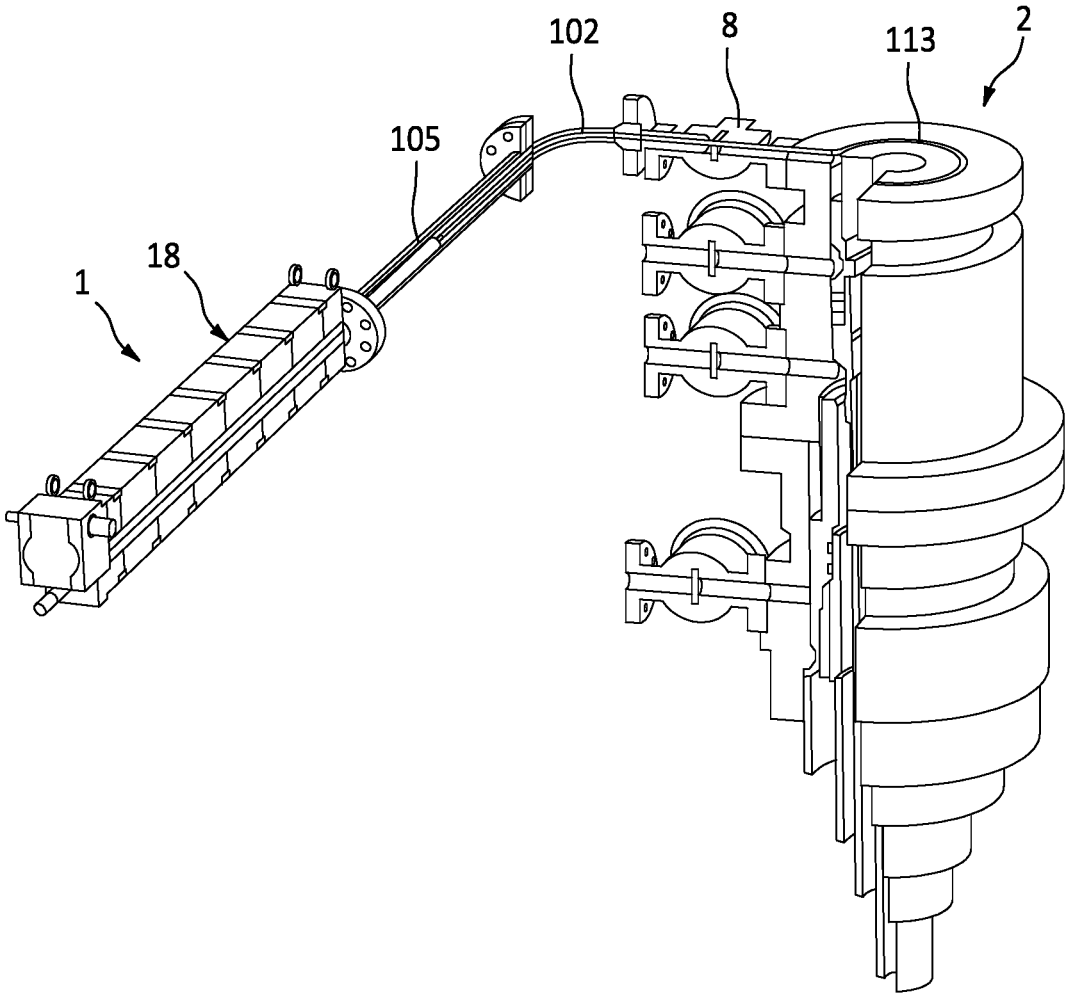
Figure 38:
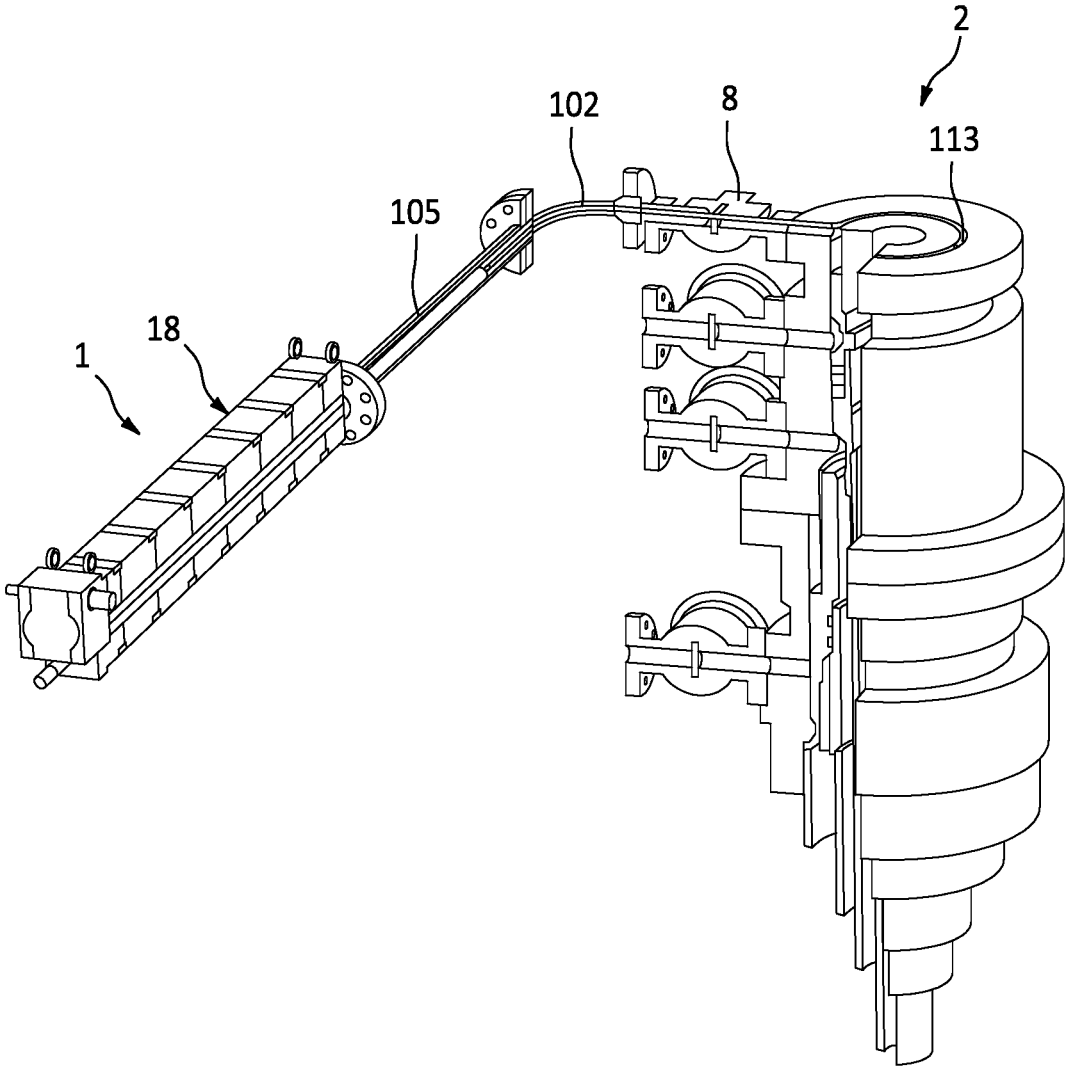
Figure 39:
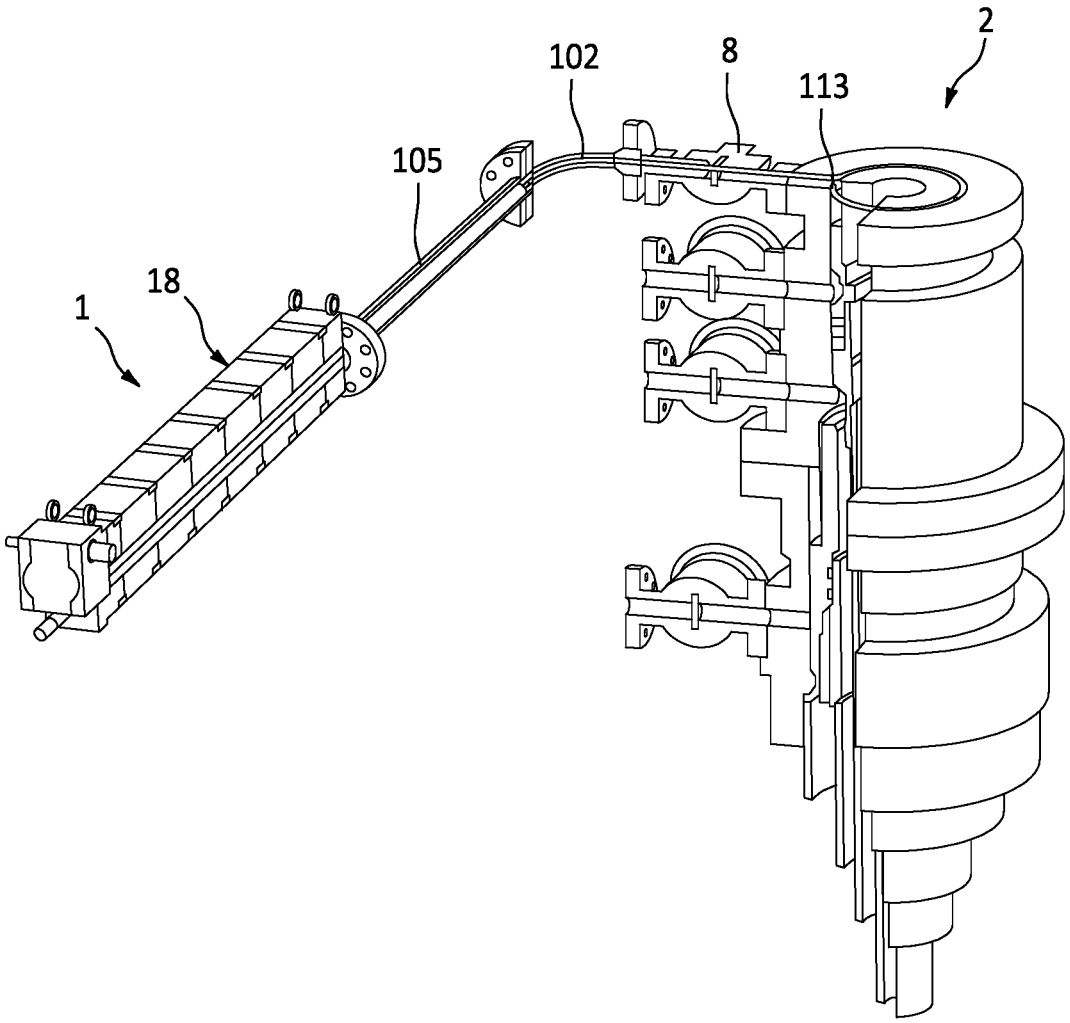

The tool 1 is operated as previously described to advance the pipe connector 54 along the straight guide passage 105, as shown sequentially in FIGS. 36, 37, 38 and 39. The straight guide passage 105 is of sufficient length so that when the pipe connector 54 reaches its front end the nozzle 113 has gone the full desired length of advancement from the gate of the valve 8, circumferentially around the annulus 12 through one full revolution. FIG. 36 shows the nozzle 113 at the inner end of the side opening 6, just as it is reaching the annulus 12. FIG. 37 shows the nozzle 113 after it has moved 90° around the annulus 12. FIG. 38 shows the nozzle 113 after it has moved just more than half of one revolution. FIG. 39 shows the nozzle 113 when it has completed one complete revolution around the annulus 12. During this advancement, the fluid transmitting cable 111 has been subjected to a forward thrust provided by the grip of the pipe connector 54 on its external surface and has been able to move forwardly under such a rearwardly applied forward thrusting force.

After the nozzle 113 has adopted the position shown in FIG. 39 it may then be retracted again by operation of the tool 1 in the manner previously described. During this retraction a sealant is supplied along the inner pipe 46 and into the fluid transmitting cable 111. The sealant may therefore be discharged continuously during withdrawal of the nozzle 113, thereby reaching the entire circumference of the annulus. This is particularly useful in the case of a large diameter annulus, for example having a circumference of the order of 1-2 meters. If the sealant was only discharged at the radially inner end of the side opening 6, it may not reach the diametrically opposite side of the annulus. This embodiment overcomes that problem.

The invention claimed is:

1. A tool for gaining lateral access to a well via a lateral access passage, the tool comprising a head portion, the head portion comprising an attachment and an adapter for removably mounting the attachment, wherein the attachment is configured to be rotationally locked to the head portion, the tool being configured to axially forwardly advance the head portion at least towards the lateral access passage and being configured to transmit rotational drive to the head portion and the attachment, and the tool comprising a fluid transmission conduit for delivering fluid to at least one of the head portion and a location forwardly of the head portion;

wherein the head portion has a sealing device for forming a seal with the lateral access passage and an outlet for discharging fluid forwardly of the seal.

2. The tool as claimed in claim 1, wherein the fluid transmission conduit is arranged to be rotationally driven.

3. The tool as claimed in claim 1, wherein the fluid transmission conduit comprises a first fluid passageway arranged to deliver fluid to the head portion, and a second fluid passageway in the head portion.

4. The tool as claimed in claim 1, wherein the sealing device comprises a circumferentially extending sealing member and first and second end members, one at each axial end of the sealing member, the first and second end members being configured to be urged axially towards each other, so as to cause the sealing member to expand radially outwardly and form said seal with the lateral access passage.

5. The tool as claimed in claim 1, wherein the head portion is configured to hold the fluid transmission conduit for forward advancement therewith and the tool comprises a flexible conduit portion extending forwardly of the head portion.

6. The tool as claimed in claim 5, comprising a nozzle at the front end of the flexible conduit portion.

7. The tool as claimed in claim 5, wherein the flexible conduit portion is provided with a convex front surface.

8. The tool as claimed in claim 5, wherein the flexible conduit portion comprises a helically wound wire with an internal axially extending passage.

9. The tool as claimed in claim 5, wherein the flexible conduit portion comprises a fluid containing material such as a plastics material.

10. The tool as claimed in claim 5, wherein the tool comprises a curved guide passage for guiding the flexible conduit portion in a curved path towards the lateral access passage.

11. The tool as claimed in claim 1, wherein a brush is attached to the head portion, and wherein the brush is arranged to undergo at least one of: rotation and axially reciprocation.

12. The tool as claimed in claim 1, wherein the attachment is one of a socket member, a sealing device and a brush.

13. A tool for gaining lateral access to a well via a lateral access passage, the tool comprising a head portion, the head portion comprising an attachment and an adapter for removably mounting the attachment, wherein the attachment is configured to be rotationally locked to the head portion, the tool being configured to axially forwardly advance the head portion at least towards the lateral access passage and being configured to transmit rotational drive to the head portion and the attachment, and the tool comprising a fluid transmission conduit for delivering fluid to at least one of the head portion and a location forwardly of the head portion, and a shaft for forwardly advancing the head portion by axial forward movement of the shaft, the shaft being coupled to a rotatable drive member configured to be rotatably driven such that rotation of the rotatable drive member causes axial forward movement of the shaft and wherein the fluid transmission conduit is arranged to be axially forwardly movable with the shaft.

14. The tool as claimed in claim 13, wherein the fluid transmission conduit is arranged to switch between a shaft following mode in which it is axially forwardly movable with the shaft and a shaft release mode in which it is axially forwardly movable relative to the shaft.

15. The tool as claimed in claim 13, wherein the fluid transmission conduit comprises an inner pipe with an external thread, wherein a bushing is axially fixed with respect to the shaft and is provided with an internal thread engaged with the external thread of the inner pipe, and wherein a switch is arranged to rotationally lock the bushing to the shaft so that it cannot rotate relative thereto and to rotatably unlock the bushing from the shaft so that it can rotate relative thereto.

16. The tool as claimed in claim 13, wherein the shaft is coupled to the rotatable drive member by an internally threaded member mounted on an external thread of the rotatable drive member, the internally threaded member being prevented from rotation whereby rotation of the rotatable drive member causes axial movement of the internally threaded member which is transmitted to the shaft.

17. The tool as claimed in claim 16, comprising an axial facing drive portion mounted to the internally threaded member and arranged to engage an axially facing driven portion mounted to the shaft for transmitting the axial movement of the internally threaded member, caused by rotation of the rotatable drive member, to the shaft.

18. The tool as claimed in claim 13, wherein the shaft comprises first and second shaft members, the first shaft member being caused to move axially forwardly when the rotatable drive member is rotated, the head portion being connected to the second shaft member, and the second shaft member being axially movable with the first shaft member and being rotatable relative thereto so it can be driven to transmit rotational drive to the head portion, and wherein the second shaft member extends coaxially with and at least partly within the first shaft member.

19. A method of gaining lateral access to a well via a lateral access passage, using a tool comprising a head portion, the head portion comprising an attachment and an adapter for removably mounting the attachment, the attachment being configured to be rotationally locked to the head portion, the tool further comprising a fluid transmission conduit for delivering fluid to at least one of the head portion and a location forwardly of the head portion, wherein the head portion has a sealing device for forming a seal with the lateral access passage and an outlet for discharging fluid forwardly of the seal, the method comprising forwardly advancing the head portion at least towards the lateral access passage, and transmitting rotational drive to the head portion and the attachment.

20. The method as claimed in claim 19, wherein the method comprises carrying out at least one operation, wherein the at least one operation comprises at least one of:

delivering fluid via the fluid transmission conduit to the head portion; and delivering fluid via the fluid transmission conduit to said location forwardly of the head portion.

* * * * *